US011378910B2

(12) United States Patent
Mukai et al.

(10) Patent No.: US 11,378,910 B2
(45) Date of Patent: Jul. 5, 2022

(54) PROCESS CARTRIDGE AND IMAGE FORMING APPARATUS

(71) Applicant: CANON KABUSHIKI KAISHA, Tokyo (JP)

(72) Inventors: Takashi Mukai, Kanagawa (JP); Takashi Hiramatsu, Tokyo (JP); Shuhei Tokiwa, Tokyo (JP); Takayuki Namiki, Kanagawa (JP); Takumi Furukawa, Shizuoka (JP); Yuichi Kikuchi, Shizuoka (JP); Kazuhiro Yamauchi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 100 days.

(21) Appl. No.: 17/068,971

(22) Filed: Oct. 13, 2020

(65) Prior Publication Data

US 2021/0116856 A1 Apr. 22, 2021

(30) Foreign Application Priority Data

Oct. 18, 2019 (JP) ..... JP2019-191539

(51) Int. Cl.
*G03G 21/16* (2006.01)
*G03G 21/18* (2006.01)
(Continued)

(52) U.S. Cl.
CPC ..... *G03G 21/1814* (2013.01); *G03G 5/0553* (2013.01); *G03G 9/08773* (2013.01); *G03G 9/1139* (2013.01); *G03G 15/0233* (2013.01)

(58) Field of Classification Search
CPC ..... G03G 5/0553; G03G 9/08773; G03G 9/1139; G03G 15/0233; G03G 15/1685; G03G 21/1814
See application file for complete search history.

(56) References Cited

U.S. PATENT DOCUMENTS 6,697,587 B2 2/2004 Harada
8,275,293 B2 9/2012 Ono
(Continued)

FOREIGN PATENT DOCUMENTS

JP 2002003651 A 1/2002
JP 2002268332 A 9/2002
(Continued)

*Primary Examiner* — Hoang X Ngo
(74) *Attorney, Agent, or Firm* — Rossi, Kimms & McDowell LLP

(57) ABSTRACT

A process cartridge is provided, which is configured to recover, with a developing member, developer remaining on an image bearing member after transfer of a developer image to a transfer receiving member, wherein a charging member has a shaft that is conductive and an elastic layer supported on the shaft and being in contact with the image bearing member; the elastic layer has a matrix containing a first rubber, and a plurality of domains containing a second rubber and an electron-conductive agent and interspersed within the matrix. The electric resistance of the domains is lower than the electric resistance of the matrix. The matrix is exposed on an outer surface of the elastic layer and forms multiple depressed portions, and the domains include a domains exposed at a bottom section of the depressed portion.

13 Claims, 11 Drawing Sheets

(51) Int. Cl.

| | |
|---|---|
| ***G03G 9/113*** | (2006.01) |
| ***G03G 9/087*** | (2006.01) |
| ***G03G 5/05*** | (2006.01) |
| ***G03G 15/02*** | (2006.01) |

(56) References Cited

U.S. PATENT DOCUMENTS

| | | | | |
|---|---|---|---|---|
| 8,491,994 | B2 | 7/2013 | Harada | |
| 11,112,748 | B2 * | 9/2021 | Yamada ..... | G03G 15/0812 |
| 2011/0013939 | A1 * | 1/2011 | Ono ..... | G03G 15/0233 399/176 |

FOREIGN PATENT DOCUMENTS

| | | | |
|---|---|---|---|
| JP | 2003316112 | A | 11/2003 |
| JP | 2011022410 | A | 2/2011 |
| JP | 2012163954 | A | 8/2012 |

* cited by examiner

FIG.9

| | EXAMPLE | | | | | | | | | | | | | | |
|---|---|---|---|---|---|---|---|---|---|---|---|---|---|---|---|
| | 1-1 | 1-2 | 1-3 | 1-4 | 1-5 | 1-6 | 1-7 | 1-8 | 1-9 | 1-10 | 1-11 | 1-12 | 1-13 | 1-14 | 1-15 |
| CHARGING ROLLER No. | c1 | c2 | c3 | c4 | c5 | c6 | c7 | c2 | c2 | c2 | c3 | c3 | c4 | c4 | c4 |
| DS(m)/DS(d) | 1.2 | 1.1 | 1.2 | 1.2 | 1.2 | 1.2 | 1.1 | 1.1 | 1.1 | 1.1 | 1.2 | 1.2 | 1.2 | 1.2 | 1.2 |
| DOMAIN VOLUME FRACTION (vol%) | 19.5 | 16.8 | 24.3 | 5.4 | 22.2 | 1.4 | 24.9 | 16.8 | 16.8 | 16.8 | 24.3 | 24.3 | 5.4 | 5.4 | 5.4 |
| DOMAIN COUNT (DOMAINS/1,000 $\mu m^3$) | 24 | 490 | 333 | 1 | 38 | 1 | 3891 | 490 | 490 | 490 | 333 | 333 | 1 | 1 | 1 |
| PRESENCE OR ABSENCE OF MULTIPLE RECESSES WITH DOMAINS AT BOTTOM | YES | YES | YES | YES | YES | YES | YES | YES | YES | YES | YES | YES | YES | YES | YES |
| DEPTH h OF DEPRESSED PORTIONS WITH DOMAINS AT BOTTOM (μm) | 2.00 | 0.70 | 0.90 | 3.90 | 1.80 | 2.40 | 0.40 | 0.70 | 0.70 | 0.70 | 0.90 | 0.90 | 3.90 | 3.90 | 3.90 |
| DEPRESSED PORTION RADIUS Rs (μm) | 0.88 | 0.33 | 0.39 | 1.71 | 0.79 | 1.05 | 0.19 | 0.33 | 0.33 | 0.33 | 0.39 | 0.39 | 1.71 | 1.71 | 1.71 |
| VOLUME RESISTIVITY OF ELASTIC LAYER (Ω·cm) | $4.7 \times 10^5$ | $3.2 \times 10^6$ | $1.0 \times 10^5$ | $1.1 \times 10^6$ | $2.3 \times 10^5$ | $9.5 \times 10^7$ | $5.2 \times 10^7$ | $3.2 \times 10^6$ | $3.2 \times 10^6$ | $3.2 \times 10^6$ | $1.0 \times 10^5$ | $1.0 \times 10^5$ | $1.1 \times 10^6$ | $1.1 \times 10^6$ | $1.1 \times 10^6$ |
| A2/A1 | 97 | 79 | 152 | 38 | 43 | 21 | 43 | 79 | 79 | 79 | 152 | 152 | 38 | 38 | 38 |
| TONER RADIUS Rt (μm) | 3.50 | 3.50 | 3.50 | 3.50 | 3.50 | 3.50 | 3.50 | 1.65 | 3.50 | 1.80 | 3.50 | 1.80 | 1.80 | 1.65 | 3.50 |
| NUMBER-AVERAGE PARTICLE DIAMETER p (μm) OF COATING MATERIAL | 0.10 | 0.10 | 0.10 | 0.10 | 0/10 | 0.10 | 0.10 | 0.10 | 0.42 | 0.39 | 0.39 | 0.39 | 0.10 | 0.10 | 0.42 |
| EXPRESSION 1 SATISFIED? | YES | YES | YES | YES | YES | YES | YES | YES | YES | YES | YES | YES | YES | NO | YES |
| EXPRESSION 2 SATISFIED? | YES | YES | YES | YES | YES | YES | YES | YES | YES | YES | YES | YES | YES | - | YES |
| EVALUATION RESULT OF IMAGE DENSITY NON-UNIFORMITY | A | A | A | A | A | A | A | A | A | A | A | A | A | B | A |

FIG.10

| | EXAMPLE | | | | | | | | | COMPARATIVE EXAMPLE | |
|---|---|---|---|---|---|---|---|---|---|---|---|
| | 1-16 | 1-17 | 1-18 | 1-19 | 1-20 | 1-21 | 1-22 | 1-23 | 1-24 | 1-1 | 1-2 |
| CHARGING ROLLER No. | c6 | c6 | c7 | c7 | c7 | c7 | c8 | c9 | c10 | c11 | c12 |
| DS(m)/DS(d) | 1.2 | 1.2 | 1.1 | 1.1 | 1.1 | 1.1 | 1.2 | 1.2 | 1.2 | 1.2 | 1.2 |
| DOMAIN VOLUME FRACTION (vol%) | 1.4 | 1.4 | 24.9 | 24.9 | 24.9 | 24.9 | 17.9 | 17.9 | 17.4 | 19.5 | 19.5 |
| DOMAIN COUNT (DOMAINS/1,000 $\mu m^3$) | 1 | 1 | 3891 | 3891 | 3891 | 3891 | 22 | 21 | 20 | 24 | 24 |
| PRESENCE OR ABSENCE OF MULTIPLE RECESSES WITH DOMAINS AT BOTTOM | YES | YES | YES | YES | YES | YES | YES | YES | YES | NO | NO |
| DEPTH h OF DEPRESSED PORTIONS WITH DOMAINS AT BOTTOM (μm) | 2.40 | 2.40 | 0.40 | 0.40 | 0.40 | 0.40 | 1.90 | 2.10 | 2.30 | 0.00 | 0.00 |
| DEPRESSED PORTION RADIUS Rs (μm) | 1.05 | 1.05 | 0.19 | 0.19 | 0.19 | 0.19 | 0.83 | 0.92 | 1.01 | - | - |
| VOLUME RESISTIVITY OF ELASTIC LAYER (Ω·cm) | $9.5\times10^7$ | $9.5\times10^7$ | $5.2\times10^7$ | $5.2\times10^7$ | $5.2\times10^7$ | $5.2\times10^7$ | $4.5\times10^5$ | $3.8\times10^5$ | $6.7\times10^5$ | $4.7\times10^5$ | $2.0\times10^5$ |
| A2/A1 | 21 | 21 | 43 | 43 | 43 | 43 | 88 | 92 | 108 | 79 | 120 |
| TONER RADIUS Rt (μm) | 1.65 | 1.80 | 3.50 | 3.50 | 2.00 | 1.80 | 3.50 | 3.50 | 3.50 | 3.50 | 3.50 |
| NUMBER-AVERAGE PARTICLE DIAMETER p (μm) OF COATING MATERIAL | 0.10 | 0.39 | 0.39 | 0.42 | 0.39 | 0.39 | 0.10 | 0.10 | 0.10 | 0.10 | 0.10 |
| EXPRESSION 1 SATISFIED? | YES | YES | YES | YES | YES | YES | YES | YES | YES | - | - |
| EXPRESSION 2 SATISFIED? | YES | YES | YES | NO | YES | NO | YES | YES | YES | - | - |
| EVALUATION RESULT OF IMAGE DENSITY NON-UNIFORMITY | A | A | A | B | A | B | A | A | A | C | C |

PROCESS CARTRIDGE AND IMAGE FORMING APPARATUS

BACKGROUND OF THE INVENTION

Field of the Invention

The present invention relates to an electrophotographic image forming apparatus for forming an image on a recording material.

Description of the Related Art

Image formation by an electrophotographic image forming apparatus (hereinafter referred to as an image forming apparatus), such as a printer or a copier, involves developing, onto an image bearing member such as a drum-type photosensitive member, an electrostatic latent image into a toner image (a developer image) that is then transferred onto a recording material, such as paper or sheets, as a target of forming an image thereon, and the developer image is then fixed. The toner remaining on a photosensitive member after the transfer process is removed from the surface of the photosensitive member by a cleaning device and is gathered within the cleaning device as waste toner; but it is preferable that such waste toner does not go out to the exterior, from, for instance, the viewpoint of environmental protection, effective use of resources, and apparatus downsizing. Therefore, cleanerless-type image forming apparatuses are known in which toner, which is to be recovered by the cleaning device and remained untransferred, is subjected to "cleaning simultaneous with development" in a developing apparatus, as a result of which the toner is recovered from the photosensitive member and reused.

Charging devices used herein rely on an ordinarily known configuration of a contact charging type, in which a charging member having charging bias applied thereto charges in turn an image bearing member through discharge of the charging member onto an image bearing member while in contact with the image bearing member. Japanese Patent Application Publication No. 2003-316112 proposes a method for improving streak-like charging defects by using a charging member having unevenness formed on a surface layer thereof by incorporation of organic fine particles into the surface layer.

Known charging members are available in which, for the purpose of imparting conductivity to an elastic layer, an electron-conductive rubber composition that contains conductive particles, such as carbon black, is utilized. However, the elastic layer thus formed is problematic in that the electric resistance of the elastic layer largely depends on the dispersion state of the conductive particles, and in that resistance unevenness within the elastic layer is significant. Further, the ease of transmission of charge between conductive particles, derived from an electric field effect, varies depending on the applied voltage. Accordingly, the voltage dependence of the electric resistance value is significant.

The movement speed of ions in ion-conductive materials varies depending on for instance the temperature and humidity of the surroundings. In consequence, the environmental dependence of the electric resistance value is large. As described above, both electron conductivity and ionic conductivity involve problems in terms of stability of charging performance, and it has been difficult to obtain uniform images stably.

To address the problem, Japanese Patent Application Publication No. 2002-003651 proposes the following semiconductive rubber composition as a semiconductive rubber composition having uniform electric characteristics, as well as small voltage dependence and small environmental fluctuations, and also proposes a charging member that utilizes the semiconductive rubber composition. Specifically, the semiconductive rubber composition has a matrix-domain structure (a sea-island structure) containing a matrix that contains an ion-conductive rubber material mainly made up of rubber having a volume resistivity of $1\times10^{12}$ Ω·cm or less, and domains containing an electron-conductive rubber material obtained by mixing conductive particles into a rubber, to render the rubber conductive.

SUMMARY OF THE INVENTION

However, the problems below-described arise in image formation in accordance with the methods of Japanese Patent Application Publication No. 2003-316112 and Japanese Patent Application Publication No. 2002-003651. The toner remaining on the image bearing member without being transferred may come into contact with the charging member during an image forming operation. A coating material that coats the toner may also come in contact with the charging member, and hence part of the coating material may detach from the toner surface and become adhered to the charging member. Hence, in the course of repeated image forming operations and repeated various image stabilization controls with use of toner, fouling that derives from adhesion of the coating material onto the charging member accumulates.

Stable charging performance elicited by the charging member having a sea-island structure can no longer be maintained when the portion at which the domains are exposed becomes fouled, on the surface of the charging member having a sea-island structure. This is because the exposed portion of the domains has lower electric resistance than that of the exposed portion of the matrix, and is readily discharged; as a result, discharge of the charging member is prone to vary due to changes in electric resistance caused by fouling on the exposed portion of the domains. To counter this, streak-like charging unevenness derived from fouling can be reduced to some extent by imparting unevenness to the surface of the charging member. However, even with such unevenness, image defects derived from defective charging may still occur as a result of fouling of the exposed portion of the domains. Specifically, the charging performance of the charging member becomes unstable, and accordingly the charging potential of the surface of the image bearing member varies, image density and/or line width deviates from desired values, charging cannot be carried out uniformly, and image defects, such as image density non-uniformity, occur. That is, problems occur in that the stable charging performance of the charging member having a sea-island structure cannot be maintained, and uniform images cannot be obtained stably, for instance, on account of prolonged use.

It is an object of the present invention to provide technology for making it possible to obtain favorable image quality stably, by suppressing defective charging derived from fouling on a charging member having a sea-island structure.

In order to attain the above goal, a process cartridge of the present invention, attachable/detachable to/from an image forming apparatus that forms an image on a recording material, has:

an image bearing member;

a charging member that is in contact with the image bearing member and charges a surface of the image bearing member; and a developing member that forms a developer image by supplying the developer to the surface of the image bearing member, which is charged by the charging member, wherein the process cartridge is configured to recover, with the developing member, the developer remaining on the image bearing member after transfer of the developer image to a transfer receiving member, wherein the charging member has a shaft that is conductive and an elastic layer supported by the shaft and being in contact with the image bearing member, wherein the elastic layer has a matrix containing a first rubber, and a plurality of domains containing a second rubber and an electron-conductive agent and being interspersed in the matrix, wherein an electric resistance of the domains is lower than an electric resistance of the matrix, wherein the matrix is exposed on an outer surface of the elastic layer and forms a plurality of depressed portions, and wherein the plurality of domains include a domain exposed at a bottom section of the depressed portion.

In order to attain the above goal, an image forming apparatus of the present invention and that forms an image on a recording material has:

an image bearing member;

a charging member that is in contact with the image bearing member and charges a surface of the image bearing member;

exposure unit for exposing the image bearing member, which is charged by the charging member, so as to form an electrostatic image on the surface of the image bearing member;

developing unit for developing the electrostatic image into a developer image; and transfer member for transferring the developer image from the image bearing member to a transfer receiving member, wherein the image forming apparatus is configured to recover, by the developing unit, developer remaining on the image bearing member after transfer of the developer image to the transfer receiving member, wherein the charging member has a shaft that is conductive, and an elastic layer supported by the shaft and being in contact with the image bearing member, wherein the elastic layer has a matrix containing a first rubber, and a plurality of domains containing a second rubber and an electron-conductive agent and being interspersed in the matrix, wherein an electric resistance of the domains is lower than an electric resistance of the matrix, wherein the matrix is exposed on an outer surface of the elastic layer and forms a plurality of depressed portions, and wherein the plurality of domains include a domain exposed at a bottom section of the depressed portion.

The present invention makes it possible to obtain good image quality stably, by suppressing defective charging derived from fouling on a charging member having a sea-island structure.

Further features of the present invention will become apparent from the following description of exemplary embodiments with reference to the attached drawings.

BRIEF DESCRIPTION OF THE DRAWINGS

FIG. 9 is a table illustrating measurement results and image evaluation results of Example 1 and Comparative Example 1;

FIG. 10 is a table illustrating measurement results and image evaluation results of Example 1 and Comparative Example 1.

DESCRIPTION OF THE EMBODIMENTS

Unless otherwise indicated, the notations "at least OO and not more than XX" and "OO to XX" representing a numerical value range in the present invention denote a range that includes the lower limit and the upper limit of the range, as endpoints thereof (numerical value range having OO as a lower limit and XX as an upper limit).

Embodiments for carrying out the invention will be described in detail below by way of examples, with reference to accompanying drawings. However, the dimensions, materials, shapes, relative arrangements and so forth of the constituent components described in the embodiments are to be appropriately modified depending on the configuration of the apparatus to which the invention is applied, and depending on various conditions. That is, the scope of the present invention is not meant to be limited to the embodiments that follow.

Embodiment 1

Outline of an Image Forming Apparatus

Figure 1:
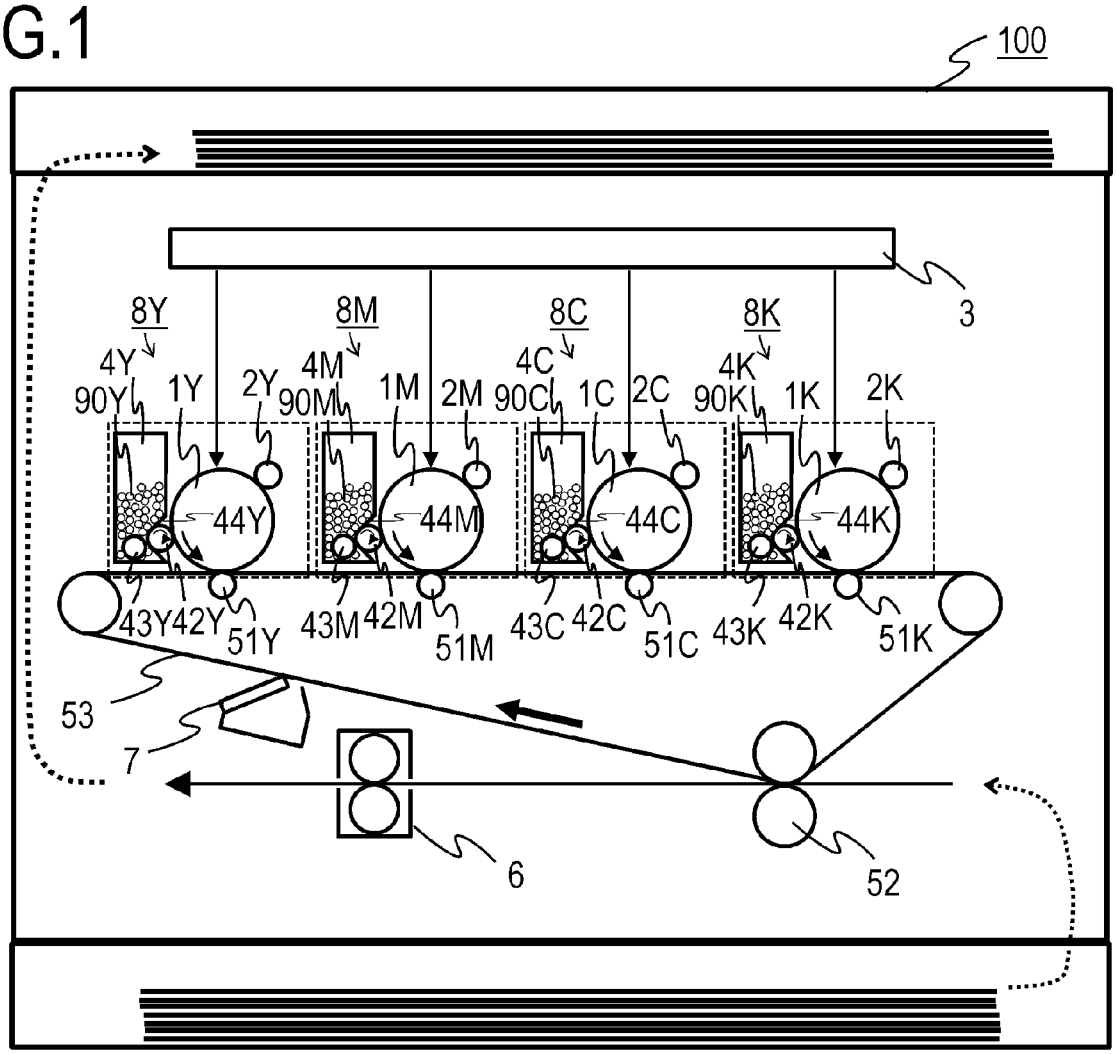
FIG. 1 is a schematic configuration diagram illustrating an example of an image forming apparatus according to an embodiment of the present invention.

The overall structure and image formation operation of an electrophotographic image forming apparatus (hereafter image forming apparatus) according to Embodiment 1 of the present invention will be explained next with reference to FIG. 1. FIG. 1 is a schematic cross-sectional diagram illustrating the schematic configuration of an image forming apparatus 100 according to an embodiment of the present invention. FIG. 1 illustrates the configuration of the image forming apparatus 100 in an ordinary installation state in which the image forming apparatus 100 is placed on a horizontal installation surface; herein the left-right direction on paper corresponds to the horizontal direction, and the top-bottom section direction on paper corresponds to the vertical direction of apparatus installation.

In the present embodiment, image forming stations of four colors, namely yellow, magenta, cyan and black are juxtaposed from the left to the right on the drawing. The image forming stations are electrophotographic image forming mechanisms having mutual identical configurations, except for the color of a developer (hereafter referred to as toner) 90 that is accommodated in a respective developing apparatus. Unless a particular distinction is called for, suffixes Y (yellow), M (magenta), C (cyan) and K (black) that are added to the reference symbols in order to denote an element provided for any respective color will be omitted in the explanation that follows, the explanation applying thus collectively to the foregoing colors.

The configuration of each image forming station includes mainly for instance a photosensitive drum 1 as an image bearing member, a charging roller 2 as a charging member, an exposure device 3, a developing apparatus 4, and a primary transfer device (primary transfer roller) 51. In the present embodiment the photosensitive drum 1, the charging roller 2 and the developing apparatus 4 are integrated as a respective process cartridge 8, that is configured to be attachable/detachable to/from an image forming apparatus body (portion of the image forming apparatus 100 that excludes the process cartridge 8). However, the process cartridge 8 in the present invention may have at least the photosensitive drum 1 and the charging roller 2, and may be configured to be collectively attachable/detachable to/from the apparatus body. A configuration may also be adopted in which the photosensitive drum 1 and the charging roller 2 are bundled with the image forming apparatus 100, thus rendering replacement by the user unnecessary. That is, cartridge configurations in which the present invention can be used are not limited to specific configurations.

Figure 2A:
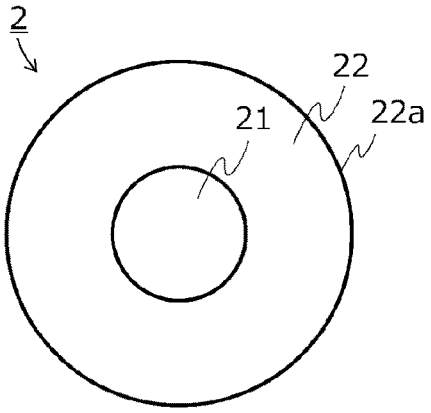
FIGS. 2A and 2B are schematic cross-sectional diagrams for explaining the configuration of a charging roller in an embodiment of the present invention.

Each photosensitive drum 1 is a cylindrical photosensitive member that rotates about the axis thereof in the counterclockwise direction denoted by the arrows. In the present embodiment, the outer peripheral surface of the photosensitive drum is rotationally driven at a moving speed of 100 mm/sec. The surface of the photosensitive drum 1 is charged uniformly by the respective charging roller 2. As illustrated in FIG. 2A, each charging roller 2 in the present embodiment is a conductive roller in which a conductive elastic layer 22 is provided on (the outer peripheral surface) of a cylindrical core metal 21 being a conductive shaft. To elicit the effect of the present invention the charging member need not have a roller shape such as that of the charging roller 2 of the present embodiment, and for instance a charging member can be used in which discharge is elicited through contact of a conductive sheet member with the photosensitive drum 1. The charging roller 2 is disposed so as to form a charged portion by coming into contact with the photosensitive drum 1 at a predetermined pressure, and rotates as driven by (following) the rotation of the photosensitive drum 1. A predetermined voltage is applied, as charging bias, to the charging roller 2, to elicit discharge as a result across the charging roller 2 and the photosensitive drum 1, and thereby charge the photosensitive drum 1 with a predetermined potential Vd. An electrostatic latent image (electrostatic image) according to an image signal by the exposure device 3 as an exposure unit becomes formed on the charged photosensitive drum 1.

The developing apparatus 4, as a developing unit, supplies the toner 90 to the electrostatic latent image on the photosensitive drum 1, to render the electrostatic latent image visible in the form of a toner image (developer image). In the present embodiment the developing apparatus 4 is a reversal developing apparatus of contact developing type that encloses the toner 90 as a one-component developer having negative normal charge polarity (charging polarity for developing the electrostatic latent image). The developing apparatus 4 is provided with a developing roller 42 as a developing member, a toner supply roller 43 and a regulating blade 44. The developing roller 42 is made up of elastic rubber or the like, and is rotationally driven by being in contact with, or by lying in the vicinity of, the photosensitive drum 1. The toner 90 enclosed in the developing apparatus 4 is supplied to the developing roller 42 by the toner supply roller 43, and is held on the developing roller 42 in a state of having been thinned by the regulating blade 44, to be used for development.

Figure 5:
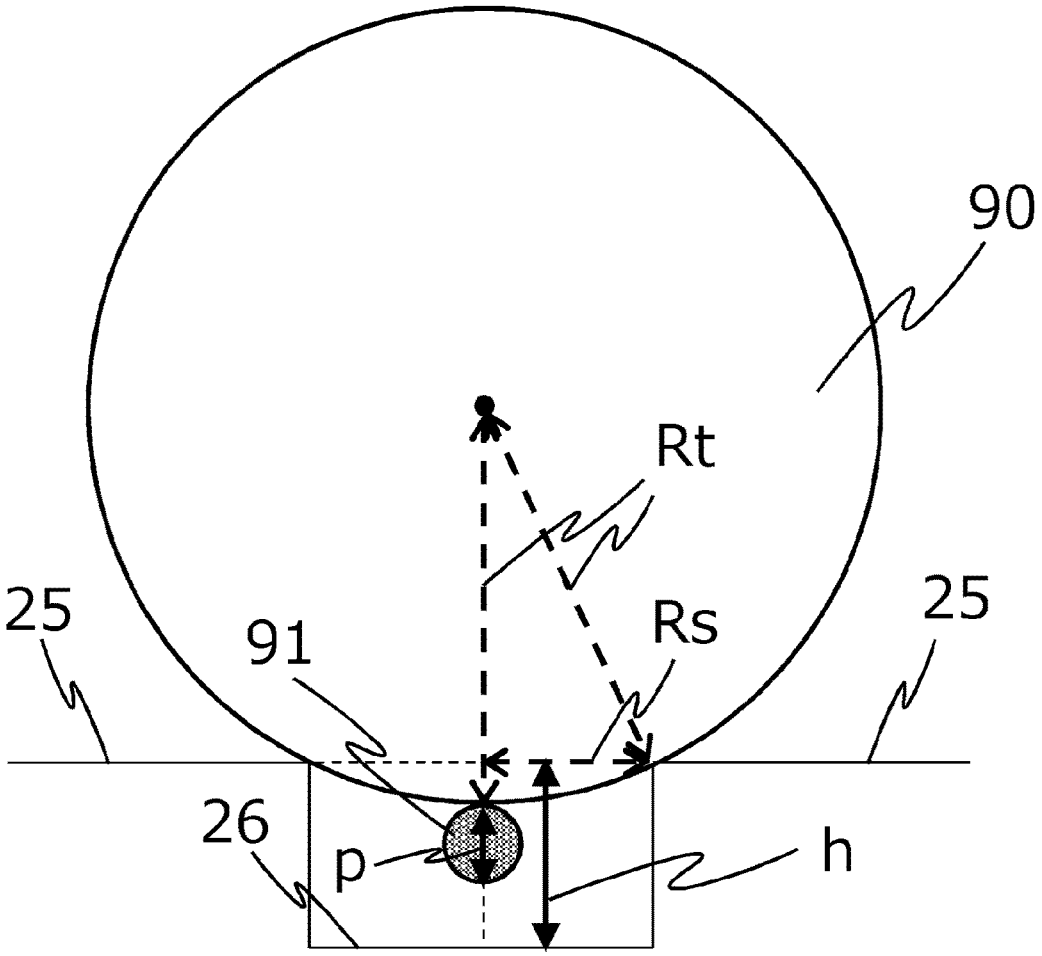
FIG. 5 is a schematic diagram illustrating a relationship between the sizes of a depressed portion, a toner particle and a coating material.

In order to improve for instance flowability and charging performance of the toner 90, the surface of a toner particle containing an organic compound which is the body of the toner 90 is coated with a coating material 91 containing an inorganic compound (FIG. 5). Examples of the coating material 91 include fine particles of inorganic oxides such as silica fine particles, alumina fine particles and titanium oxide fine particles, fine particles of inorganic stearic acid compounds such as fine particles of aluminum stearate and fine particles of zinc stearate, and fine particles of inorganic titanate compounds such as strontium titanate and zinc titanate. The foregoing can be used singly; alternatively, two or more types may be used concomitantly. In order to prevent drops in fixing performance on the recording material and prevent contact of the photosensitive drum 1 by the coating material 91, while improving for instance the flowability and charging performance by the coating material 91, the total amount of the various types of coating material 91 is set to the following values relative to 100 parts by mass of a toner particle: specifically, preferably at least 0.05 parts by mass and not more than 5.00 parts by mass, and more preferably at least 0.10 parts by mass and not more than 3.00 parts by mass.

The toner image formed on the photosensitive drum 1 is electrostatically transferred, by the primary transfer roller 51 as a first transfer member, to an intermediate transfer belt 53 as a transfer receiving body. The toner images of respective colors are sequentially transferred, superimposed on each other, onto the intermediate transfer belt 53, to form a full-color toner image. The full-color toner image is transferred to a recording material by a secondary transfer device (secondary transfer roller) 52 as a second transfer member. Thereafter, the toner image on the recording material is fixed to the recording material by pressing and heating, and is outputted, by a fixing apparatus 6, as an image-formed product.

A belt cleaning device 7 disposed downstream of the secondary transfer roller 52 in the movement direction of the intermediate transfer belt 53 removes and recoats toner 90 remaining on the intermediate transfer belt 53.

For instance the photosensitive drum 1, the developing roller 42, the toner supply roller 43, the primary transfer roller 51, the secondary transfer roller 52, the intermediate transfer belt 53, a transport roller, not shown, for transporting the recording material, a pressure roller of the fixing apparatus 6 and so forth are caused to rotate by a driving force transmitted from various motors (power supplies) provided in the apparatus body.

In addition, a power supply for applying a predetermined voltage to each of the charging roller 2, the developing roller 42, the primary transfer roller 51, the secondary transfer roller 52 and so forth is attached to the apparatus body.

Figure 11:
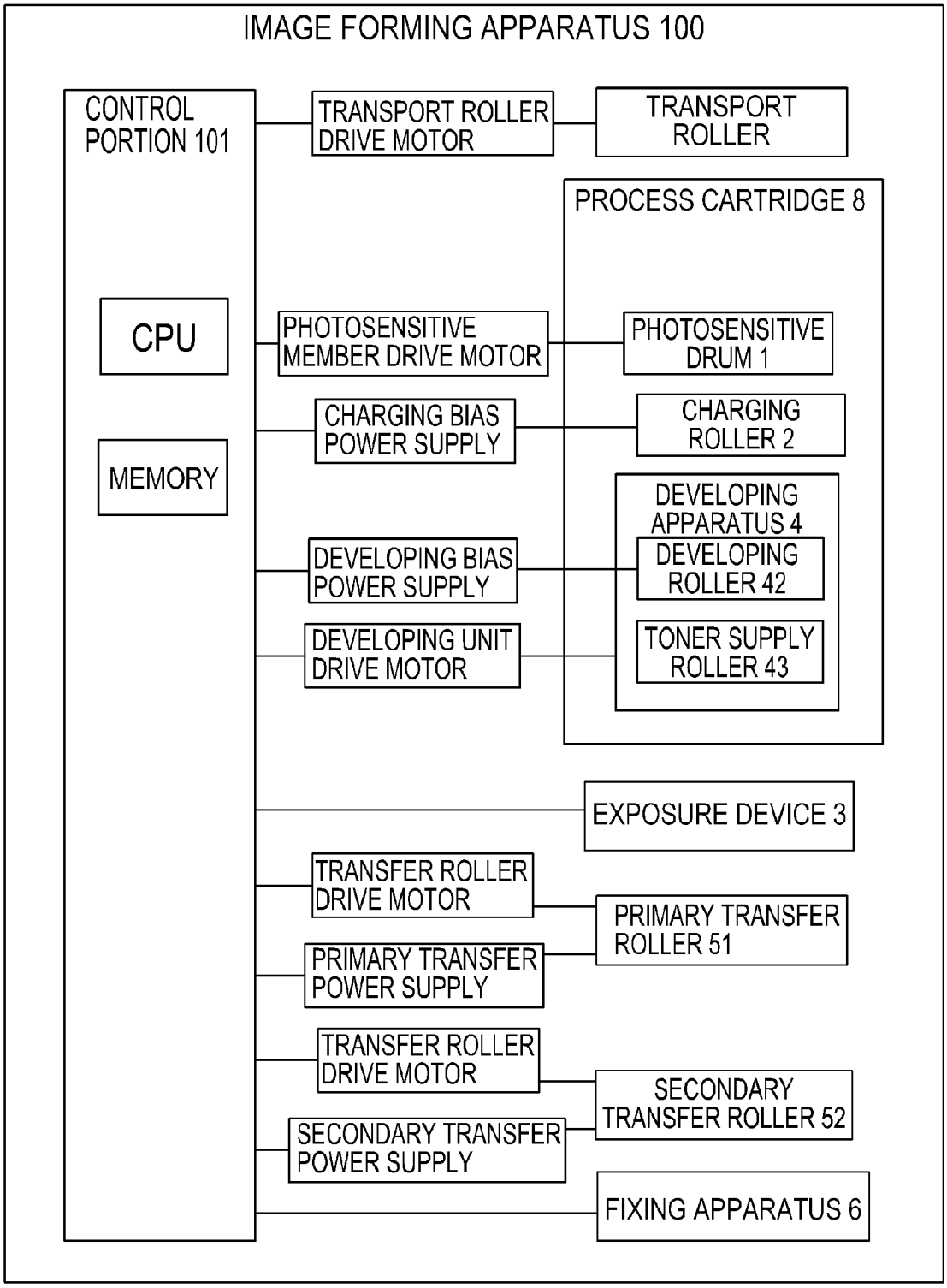
FIG. 11 is a control block diagram of an image forming apparatus according to an embodiment of the present invention.

The control block diagram illustrated in FIG. 11 depicts schematically an example of the control configuration of the image forming apparatus according to the present example. Just one representative process cartridge 8 is depicted herein. The driving control configuration of the intermediate transfer belt 53 is omitted in the figure. The control portion 101, which has for instance a CPU and a memory, receives image information and print instructions transmitted from an external device such as a host computer, and controls the image forming operation of the image forming apparatus 100. That is, the various operations of the image forming operation explained herein are controlled by the control portion 101.

Each image forming station utilizes an image bearing member cleanerless system in which the photosensitive drum 1 is not provided with a dedicated cleaning device. There is no member that comes into contact with the surface of the photosensitive drum 1, until the surface of the photosensitive drum 1 that has passed a facing position (primary transfer position) of the primary transfer device 51 reaches the charged portion. In the rotational direction of the photosensitive drum 1, specifically the charged portion at which the charging roller 2 charges the photosensitive drum 1 is positioned downstream of a primary transfer portion at which the toner image is transferred to the intermediate transfer belt 53, and upstream of an exposure portion by the exposure device 3 and a developing portion by the developing apparatus 4. As a result, the toner 90 remaining on the photosensitive drum 1 can be recovered by the developing roller 42 at the developing portion which is the facing position between the photosensitive drum 1 and the developing roller 42 of the developing apparatus 4. That is, in a case where in the developing portion the residual toner 90 is a non-image forming portion, the residual toner 90 becomes adhered to and recovered on the developing roller 42, from the photosensitive drum 1, on account of the electrostatic force relationship between the photosensitive drum 1 and the developing roller 42, and the recovered toner is returned into a toner accommodating portion of the developing apparatus 4.

The toner 90 remaining on the photosensitive drum 1 without being transferred to the intermediate transfer belt 53 by the primary transfer device 51 passes through the charged portion, and thereafter is recovered by the developing apparatus 4. At this time, part of the coating material 91 may detach from the surface of the toner 90 and adhere to the charging roller 2, since the coating material 91 covering the toner 90 is in contact with the charging roller 2.

A cleanerless configuration has been explained in the present embodiment, but a cleaning member may be provided between the charged portion and the primary transfer portion.

Configuration of Charging Roller

Figure 2B:
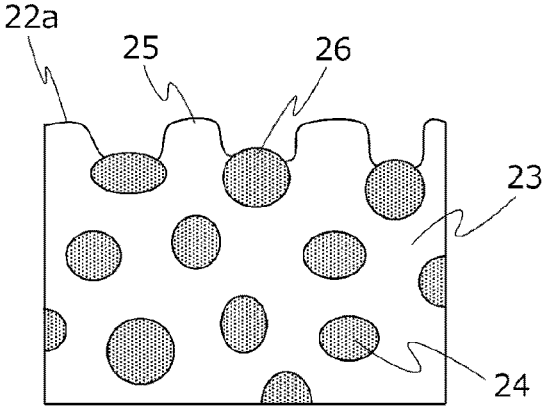

The charging roller 2 according to the present embodiment and an elastic layer 22 thereof will be explained next with reference to FIGS. 2A and 2B. FIG. 2A is a schematic cross-sectional diagram illustrating the schematic configuration of the charging roller 2 according to the present embodiment, as viewed from the rotation axis direction of the charging roller 2. FIG. 2B is a schematic cross-sectional diagram illustrating an enlargement of the elastic layer 22 including the surface 22*a* of the charging roller 2 according to the present embodiment.

As illustrated in FIG. 2A, the charging roller 2 has a core metal 21 as a conductive shaft and an elastic layer 22 provided on the outer periphery of the core metal 21. The surface 22*a* of the elastic layer 22 is in contact with the photosensitive drum 1, and constitutes a surface of discharge onto the photosensitive drum 1.

As illustrated in FIG. 2B, the elastic layer 22 has a matrix 23 containing an ion-conductive rubber A, and electron-conductive domains 24 containing a rubber B and an electron-conductive material. A matrix-domain structure (sea-island structure) is configured in which the matrix 23 forms a sea phase and the domains 24 form island phases that are scattered/interspersed at a plurality of sites within the matrix 23.

In the charging roller 2 (charging member) according to the present embodiment the domains 24 and the matrix 23 are exposed, at a predetermined ratio of electric resistance, on the outer peripheral surface of the charging roller 2 (outer peripheral surface 22*a* of the elastic layer 22). The matrix 23 forms the outer peripheral surface of the charging roller 2 to an uneven shape, while the domains 24 are exposed at the bottom section of depressed portions 26 in the uneven surface of the charging roller 2 (matrix 23). The structure of the outer peripheral surface can be formed in accordance with the below-described production method.

As a result, the domains 24 functioning as discharge points are present in the depressed portions 26 on the surface of the charging roller 2, and hence the surface of the toner 90 does not come readily into contact with the domains 24 at the charging member surface, at the contact position between the charging roller 2 and the photosensitive drum 1, which is a body to be charged. It becomes possible as a result to prevent the coating material 91 on the surface of the toner 90 from adhering to the domains 24, and to suppress defective charging derived from fouling on the charging roller 2, and to stably achieve good image quality. Details are set out further on.

The resistance ratio of the matrix 23 with respect to the domains 24 is a predetermined ratio, such that the electric resistance of the domains 24 is lower than the electric resistance of the matrix 23. This can be ascertained, in the below-described measurement, on the basis of the fact that a current value in the domains 24 being larger than a current value in the matrix 23.

Multiple domains 24 having lower electric resistance than that of the matrix 23 resistance are exposed, in a scattered fashion, on the surface 22*a* of the elastic layer 22. The potential difference with respect to the photosensitive drum 1 which is the body to be charged is larger, and discharge from the charging roller 2 occurs more readily, from a portion of relatively low electric resistance. Therefore, the exposed portion of the domains 24 becomes discharged more readily than the exposed portion of the matrix 23.

In consequence, the domains 24 exposed and dispersed on the surface of the charging roller 2 constitute discharge points, and as a result the charging roller 2 of the present embodiment can be charged more uniformly than a charging roller covered by the matrix 23 without domains 24 exposed at the surface. However, defective charging is prone to occur when fouling derived from the coating material 91 that coats the toner 90 adheres to/accumulates on the domains 24 of low electric resistance.

In the present embodiment, therefore, the domains 24 exposed on the surface 22*a* of the charging roller 2 and which constitute discharge points are prescribed to be exposed at the bottom section of the depressed portions 26, as a result of which the domains 24 do not come readily in contact with the coating material 91 that coats the toner 90, and fouling caused by contact with the coating material 91 is suppressed, which translates into in suppression of defective charging. It becomes in consequence possible to maintain a stable charging performance by virtue of the fact that electrical characteristics are uniform and voltage dependence and environmental fluctuations are small, the foregoing being characterizing features of the charging roller 2 of sea-island structure.

The surface 22*a* of the elastic layer 22 of the charging roller 2 in the present embodiment has therefore a plurality of depressed portions 26, as illustrated in FIG. 2B. The domains 24 are present at the bottom section of the depressed portions 26, and are exposed at the surface 22*a* of the elastic layer 22 only at the bottom section of the depressed portions 26. Meanwhile, protruded portions 25 are formed so as to surround the plurality of depressed portions 26, so that the matrix 23 is exposed at the protruded portions 25.

The volume fraction of the domains 24 is preferably at least 5 vol % and not more than 25 vol % with respect to the volume of the elastic layer 22. If the volume fraction is 5 vol % or more, the discharge required as a charging member can be achieved without increasing the conductivity of the matrix 23. If by contrast the volume fraction of the domains 24 is 25 vol % or less, the electric resistance of the elastic layer 22 as a whole is lower, and over-discharge can be suppressed. Further, the volume fraction of the domains 24 ranges more preferably from 10 vol % to 20 vol %.

The number of domains 24 (hereafter referred to as "domain count") in a cube having a side of 10 μm in the elastic layer 22 is preferably at least 1 and not more than 500. In the above domain count and volume fraction, the diameter of the domains 24 is about from 0.5 μm to 5 μm. By virtue of the fact that the domain count is 500 or fewer it becomes possible to lower the electric resistance of the elastic layer 22 as a whole, as well as the occurrence of over-discharge, caused by domains 24 connecting with one another or coming too close to one another. Thanks to the domain count being one or more, meanwhile, it becomes possible to do away with the need for increasing the conductivity of the matrix 23 on account of the scant number of domains 24, and to suppress insufficient discharge arising from the high electric resistance of the elastic layer 22 as a whole.

Preferably, the depth of the depressed portions 26 on the bottom section of which the domains 24 are exposed is at least 1.0 μm and not more than 4.0 μm. A depth of the depressed portions 26 being 1.0 μm or larger is preferable herein since in that case contact between the domains 24 and the photosensitive drum 1 is suppressed, in a state where the charging roller 2 is in contact with the photosensitive drum 1, and fouling derived from the toner 90 and/or coating material 91 adhered to the photosensitive drum 1 is suppressed. Thanks to a thickness of 4.0 μm or less, meanwhile, the toner 90 can be electrostatically returned towards the photosensitive drum 1 even in cases where the toner 90 is adhered to the depressed portions 26.

Material of Elastic Layer

The domains 24 are made up of an electron-conductive rubber material. The electron-conductive rubber material includes rubber materials resulting from dispersing carbon black, as conductive particles (electron-conductive agent), in a binder polymer that by itself does not exhibit conductivity, to thereby adjust the electric resistance of the rubber material.

As the binder polymer, a rubber composition containing for instance butadiene rubber, acrylonitrile-butadiene rubber, isoprene rubber, chloroprene rubber, styrene-butadiene rubber, ethylene-propylene rubber, polynorbornene rubber or epichlorohydrin rubber, conventionally used in conductive elastic layers of charging members, for instance in conductive elastic layers of charging rollers for electrophotographic devices, is suitably used herein as a second rubber.

The type of carbon black contained in the domains 24 is not particularly limited as long as it is conductive carbon black capable of imparting conductivity to the domains 24. Specific examples thereof include for instance gas furnace black, oil furnace black, thermal black, lamp black, acetylene black and Ketjen black.

The rubber composition that forms the domains 24 may further have added thereto, as needed, a filler, a processing aid, a cross-linking aid, a cross-linking accelerator, a cross-linking promoter, a cross-linking retardant, a softener, a dispersing agent, a colorant or the like, which are generally used in rubber formulations.

The matrix 23 does not contain conductive particles such as carbon black, and has thus higher electric resistance than the domains 24. As a binder polymer contained in the matrix 23, a rubber composition including for instance butadiene rubber, isoprene rubber, chloroprene rubber, styrene-butadiene rubber, ethylene-propylene rubber, polynorbornene rubber or epichlorohydrin rubber, conventionally used in conductive elastic layers of charging members, for instance in conductive elastic layers of charging rollers for electrophotographic apparatuses, is suitably used herein as a first rubber.

An ion-conductive agent may be added to the rubber composition that makes up the matrix 23, in an amount such that bleed-out does not occur, for the purpose of adjusting the volume resistivity of the elastic layer 22 to a medium resistance region (for instance $1.0\times10^5$ Ω·cm to $1.0\times10^8$ Ω·cm) that is suitable as a charging member.

Examples of the ion-conductive agent include inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfates; amphoteric surfactants such as laurylbetaine, stearylbetaine and dimethylalkyllaurylbetaines; quaternary ammonium salts such as tetraethylammonium perchlorate, tetrabutylammonium perchlorate and trimethyloctadecylammonium perchlorate; as well as organic acid lithium salts such as lithium trifluoromethanesulfonate.

The compounding amount of such an ion-conductive agent is for instance at least 0.5 parts by mass and not more than 5.0 parts by mass relative to 100 parts by mass of the ion-conductive rubber.

Furthermore, spherical particles having a particle diameter in the range of 1 μm to 90 μm may be added to the rubber composition that makes up the matrix 23. Specific examples include for instance at least one type of spherical particles selected from among phenolic resin particles, silicone resin particles, polyacrylonitrile resin particles, polystyrene resin particles, polyurethane resin particles, nylon resin particles, polyethylene resin particles, polypropylene resin particles, acrylic resin particles, silica particles and alumina particles. Through the use of such a rubber composition, the outer surface of the elastic layer 22 can constitute a charging member having protruded portions 22*b* derived from the spherical particles.

Figure 7:
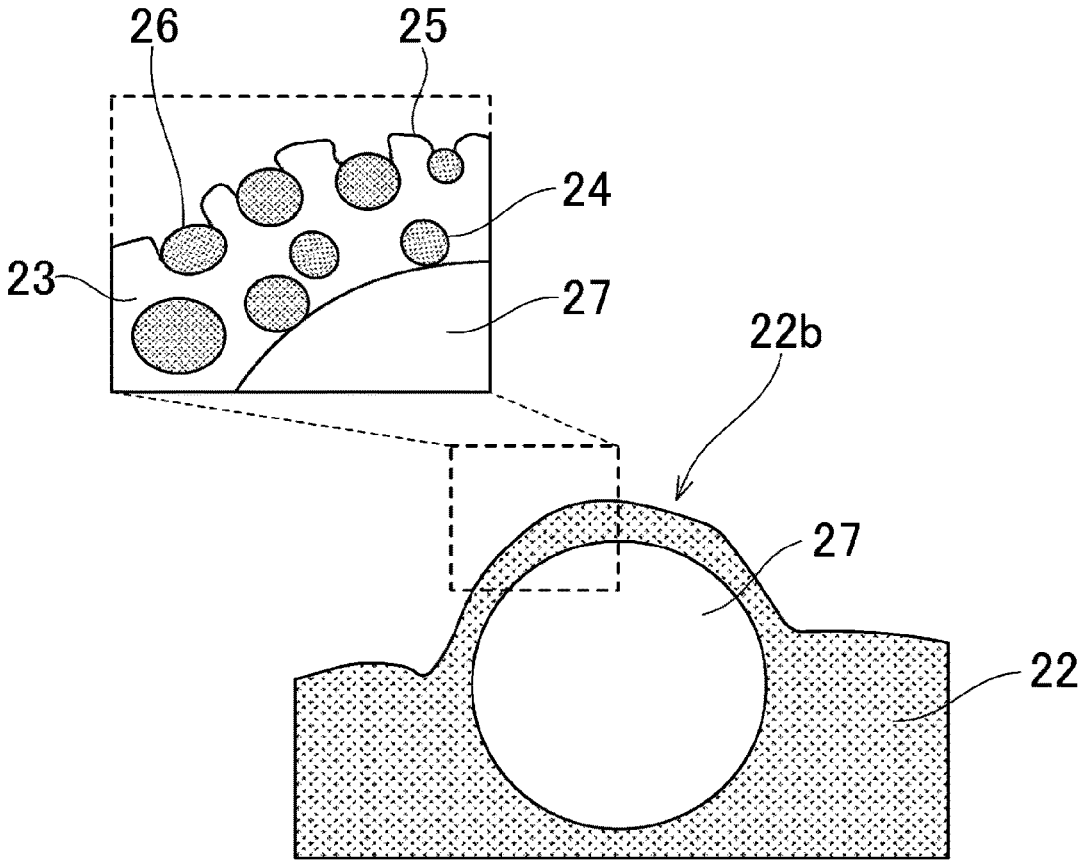
FIG. 7 is an enlarged cross-sectional diagram including the surface of a protruded portion derived from a spherical particle of an elastic layer.

FIG. 7 is an explanatory diagram of a charging member according to the present embodiment, wherein the elastic layer 22 contains spherical particles 27, and the outer surface of the elastic layer 22 has the protruded portions 22*b* derived from the spherical particles 27. Specifically FIG. 7 is a schematic cross-sectional diagram resulting from cutting, along the thickness direction of the elastic layer 22, a portion of the elastic layer 22 in which there is formed a protruded portion 22*b* derived from a respective spherical particle 27, and is a partial enlarged-view diagram of the outer surface of the protruded portions 22*b*. As illustrated in FIG. 7 the outer surface of each protruded portion 22*b* derived from a respective spherical particle 27 has a plurality of depressed portions 26, such that domains 24 are exposed at the bottom sections the depressed portions 26. As a result the conductive domains 24 do not come readily into direct contact with the surface of the toner 90, even when the protruded portions 22*b* derived from spherical particles 27 are present on the outer surface.

When an incompatible polymer blend is used as the material of the elastic layer 22, generally a rubber composition of high composition ratio and low viscosity tends to be present in the matrix 23, although the matrix-domain structure of the polymer blend depends herein on the polymer viscosities and blending conditions. Therefore, the volume fraction of the domains 24 is preferably at least 5 vol % and not more than 25 vol %. Stable domains 24 can be formed as a result, and the matrix-domain structure of the conductive rubber composition as a whole is stabilized.

In order to further bring out a stable matrix-domain structure, the viscosity of the domains is more preferably higher than the viscosity of the matrix, with a viscosity difference between the domains and the matrix of at least 5 points and not more than 60 points of a ML 1+4 value at 100° C., using a Mooney viscometer (SMV-300, Shimadzu Corporation).

Conductive Support

The core metal 21 as the conductive shaft has conductivity, and it suffices that the core metal 21 can support for instance the elastic layer 22 and can typically maintain the strength of the charging roller 2, as a charging member.

Method for Producing Charging Roller

An effective method from the viewpoint of involving a simple production process will be explained next as a production method of the charging roller 2 according to the present embodiment. The production method includes steps (A) to (D) below.

(A) step of preparing a carbon masterbatch (CMB) for forming the domains 24, and that contains carbon black and rubber;

(B) step of preparing a rubber composition that constitutes the matrix 23;

(C) step of kneading the carbon masterbatch and the rubber composition, to prepare a rubber composition having a matrix-domain structure; and (D) step of extruding the rubber composition having the matrix-domain structure from a crosshead, together with a core metal, to thereby coat the periphery of the core metal with the rubber composition having the matrix-domain structure.

A ratio DS(m)/DS(d) is set so as to be higher than 1.0, where DS(d) denotes a die swell value of the carbon masterbatch prepared in step (A) and DS(m) denotes the die swell value of the rubber composition prepared in step (B). The charging member according to the present embodiment can be formed as a result.

Die swell values will be explained next. When rubber is extruded using a die extruder, the rubber having been compressed by the pressure applied thereto, in the interior of the extruder, is extruded out of a discharging port; as a result, pressure is relieved and the extruded rubber expands, the thickness of the expanded rubber becoming in turn larger than the gap of the discharging port of the die. The die swell value is an index denoting the degree of expansion of the rubber when extruded from the discharging port.

In the method for producing a charging member according to the present embodiment a rubber composition having a matrix-domain structure is prepared through mixing of a carbon masterbatch for forming the domains 24 and a rubber composition for forming the matrix 23, satisfying the relationship DS(m)/DS(d)>1.0. Then, the rubber composition having the matrix-domain structure is extruded through the discharging port of the crosshead, while allowing the rubber composition to swell. By doing so the matrix 23 around the domains 24 present on the surface of the rubber layer rises up given that the expansion rate of the matrix 23 is higher than the expansion rate of the domains 24; as a result there is formed a layer of an unvulcanized rubber composition derived from the presence of the domains 24 at the bottom section of the depressed portions 26, and having depressed portions 26 at the surface. Preferably, the above ratio DS(m)/DS(d) is set to 1.1 or higher, in order to facilitate formation of the surface layer according to the present embodiment.

The die swell values of the carbon masterbatch for forming the domains 24, and of the rubber composition for forming the matrix 23, can be adjusted on the basis of for instance the type and amount of an added filler. Specifically, the die swell value decreases as the addition amount of the filler increases. The reduction in die swell value is greater when using a filler exhibiting a high rubber reinforcing effect, such as carbon black or silica, or a scaly filler such as bentonite or graphite, than when using calcium carbonate.

Examples of methods for producing an unvulcanized rubber composition having a matrix-domain structure, through kneading of a CMB that constitutes the domains 24 and an unvulcanized rubber composition that constitutes the matrix 23, in step (C) above, include for instance the methods set out in (i) and (ii) below.

(i) Method in which the CMB constituting the domains 24 and the unvulcanized rubber composition constituting the matrix 23 are mixed using a close-type mixer such as a Banbury mixer or a pressure kneader, followed by integration, through kneading, of the CMB constituting the domains 24 and the unvulcanized rubber composition constituting the matrix 23 with a starting material in the form of a vulcanizing agent or vulcanization accelerator, using an open-type mixer such as an open roll.

(ii) Method in which the CMB constituting the domains 24 is mixed using a close-type mixer such as a Banbury mixer or a pressure kneader, after which the CMB constituting the domains 24 and a starting material of the unvulcanized rubber composition constituting the matrix 23 are mixed in a close-type mixer, followed by integration, through kneading, of the foregoing with a starting material in the form of a vulcanizing agent or vulcanization accelerator, using an open-type mixer such as an open roll.

The layer of unvulcanized rubber composition having depressed portions on the surface and in which the domains 24 are present at the bottom section of the depressed portions, in step (D), undergoes subsequently a vulcanization step as step (E), to yield the surface layer of the charging roller 2 according to the present embodiment. Concrete examples of heating methods include hot-air oven heating in a gear oven, heating vulcanization with far infrared rays, and steam heating in a vulcanizer. Hot-air oven heating and far-infrared heating are preferable among the foregoing by virtue of being suitable for continuous production.

In order to better preserve the surface profile at which the domains 24 are present at the bottom section of the depressed portions 26, and that is formed in accordance with the above method, it is preferable not to polish the surface of the obtained charging roller 2. Therefore, in a case where the outer shape of the elastic layer 22 of the charging roller 2 according to the present embodiment is formed as a crowned shape, preferably the extrusion rate of the core metal, and the extrusion rate of the unvulcanized rubber composition from the crosshead, are controlled so as to form the outer diameter shape of the unvulcanized rubber layer to a crowned shape. The term crowned shape denotes a shape in which the outer diameter of the central portion of the core metal 21 of the elastic layer 22, in the longitudinal direction, is larger than the outer diameter at the ends.

The vulcanized rubber composition at both ends of the vulcanized rubber roller is removed in a later separate step, whereupon the vulcanized rubber roller is completed. Therefore, both ends of the core metal 21 in the completed vulcanized rubber roller are exposed. The surface layer may be subjected to surface treatment by being irradiated with ultraviolet rays or electron beams.

Check for Presence or Absence of Matrix-domain Structure; Measurement of Domain Count and Volume Fraction Examples of a method for checking the presence or absence of a matrix-domain structure, and of a method for measuring a domain count and a volume fraction of the domains 24, will be explained next. A slice having a thickness of 1 mm is cut out from the elastic layer 22 of the charging roller 2. This slice is immersed in a 5% aqueous solution of phosphotungstic acid for 15 minutes, and is then removed, washed with pure water, and dried at room temperature (25° C.). The matrix-domain structure of a stained slice thus obtained is observed using FIB-SEM (DualBeam SEM Helios 600, by FEI Company). The specific measurement method is described below.

The blade of a cutter is pressed perpendicularly to the surface of the elastic layer 22 of the charging roller 2, to cut a 1 mm square slice in the x-axis direction (roller longitudinal direction) and the y-axis direction (tangential direction of a circular cross section being a cross section of the roller perpendicular to the x axis). The cut slice is observed using an FIB-SEM device at an acceleration voltage of 10 kV, and magnifications of 1,000×, in the z-direction (normal direction of the roller surface, perpendicular to the xy plane). Next, a total of 100 cross-sectional images are captured up to a depth of 10 μm from the surface, at 100 nm intervals in the z-direction, using a gallium ion beam and at an ion beam current amount of 20 nA.

The presence or absence of a matrix-domain structure is ascertained from a three-dimensional image obtained through three-dimensional reconstruction from the cross-sectional image, and the number of domains 24 in a cube having a side of 10 μm is counted. In counting of the number of domains, those domains 24 with part thereof at the boundary of the image are excluded, and there is counted the number of domains 24 for which the diameter of a true sphere corresponding to the volume of the respective domains 24 is 200 nm or larger.

Similarly, the volume fraction of the domains 24 was also measured from a three-dimensional image obtained through three-dimensional reconstruction from the above cross-sectional image. The volumes of the domains 24 in which the diameter of a true sphere corresponding to the volume of the respective domains 24 is 200 nm or greater were integrated, and the percentage resulting from dividing the result by a total of the volume of the domains 24 plus the volume of the matrix 23 was taken as the volume fraction of the domains 24.

Measurement of Volume Resistivity of Elastic Layer

The elastic layer 22 of the charging roller 2 was cut out with a razor to obtain a semi-cylindrical rubber slice. The volume resistivity of the cut surface of the rubber was measured in accordance with a 4-terminal 4-probe method. Measurement conditions included using a resistivity meter (Loresta GP, by Mitsubishi Chemical Analytech Co., Ltd.) in an environment at 23° C./50% RH (relative humidity), with applied voltage of 90 V, load of 10 N, pin-to-pin distance of 1.0 mm, pin tip of 0.04 R and spring pressure of 250 g.

Measurement of Depth of Depressed Portions and of Current Values

Figure 8:
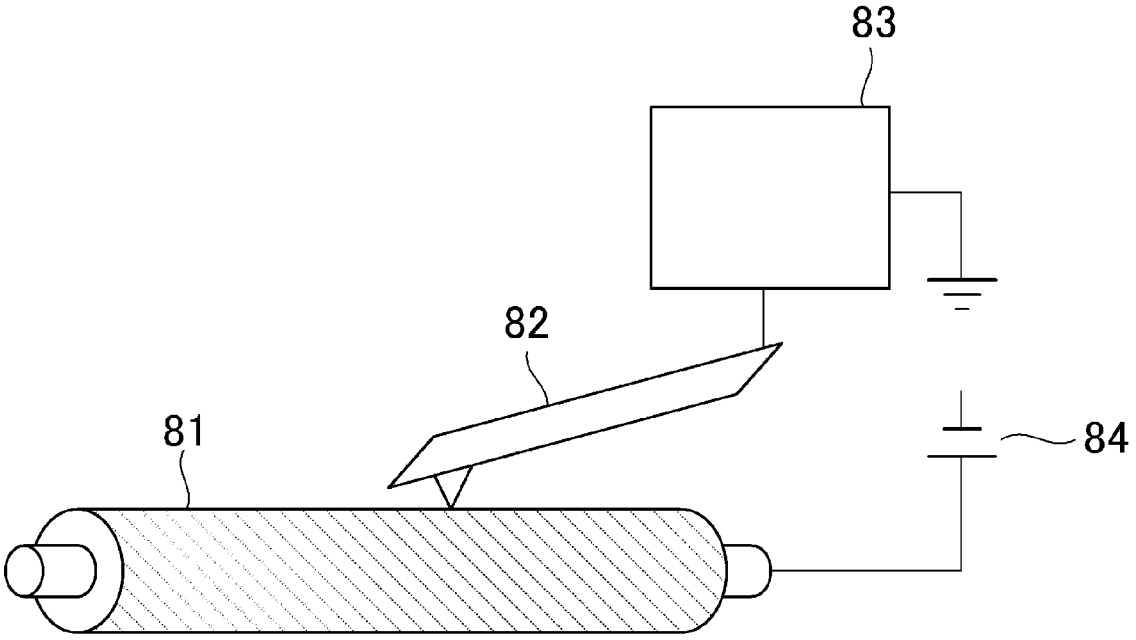
FIG. 8 is a schematic configuration diagram of a device for current measurement in a charging roller, by AFM.

The surface profile of the elastic layer 22 of the charging roller 2, the presence of the that the domains 24 at the bottom section of the depressed portions 26, as well as current values of the matrix 23 and the domains 24, can be worked out using measured values resulting from measurements performed with atomic force microscope (AFM) (Easy Scan2 by Nanosurf AG). FIG. 8 illustrates a configuration diagram of a conductivity measuring device. Herein a DC power supply (PL-650-0.1, by Matsusada Precision Inc.) 84 is connected to a conductive substrate of the charging roller 81, and 80 V are applied thereto; then the free end of a cantilever 82 is brought into contact with the surface layer, and a current image is obtained through an AFM body 83. Measurement conditions were set to cantilever: ANSCM-PC; measurement environment: atmospheric air; operation mode: spreading resistance; set point: 20 nN; P-gain: 3,000; I-gain: 600; D-gain: 0; tip voltage: 3 V; image width: 100 μm; and number of lines: 256.

A composition image of the matrix-domain structure resulting from observing beforehand the surface 22*a* of the elastic layer 22 using a scanning electron microscope (SEM) (S-3700N, by Hitachi High-Technologies Corporation), and a shape image and current image of AFM measurement, are aligned while under simultaneous measurement of the depth and current values of the depressed portions 26 at which the domains 24 are exposed. The conditions for measuring the composition image by SEM are not particularly limited so long as a distinct image can be obtained, but the measurement can be performed with settings of degree of vacuum: high vacuum; signal: BSE (COMPO); acceleration voltage: 15 kV; and WD: 5 mm.

Figure 4:
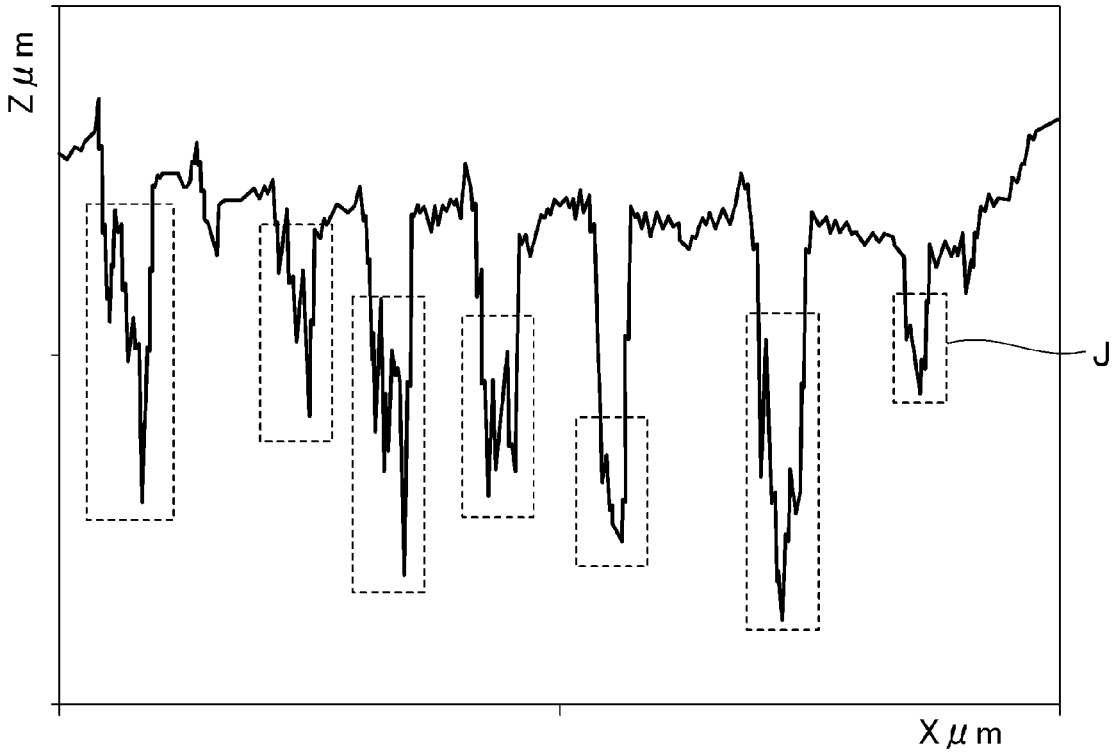
FIG. 4 is a diagram illustrating a shape image of a shape measurement of a depressed portion.

A shape image and a current image are acquired simultaneously at the time of this AFM measurement. The portion of the domains 24 in the composition image obtained by SEM beforehand is extracted from the shape image obtained by AFM. FIG. 4 is a line profile of the shape image of the AFM, such that a region J within the dashed line depicts the portion of the extracted domains 24. The portions above the average value, in the height direction Z μm of the entire measured region, can be regarded as the protruded portions 25, and the regions present below the average value can be regarded as the depressed portions 26; FIG. 4 reveals that the domains 24 are exposed at the bottom face of a plurality of depressed portions 26. A value obtained by subtracting the average value in the height direction Z μm of the area J from the average value of a portion other than the region J was measured at five arbitrary sites at dissimilar positions in the longitudinal direction of the charging roller 2, and an average value of the obtained measured value was taken as the depth h (average depth) of the depressed portions 26.

In addition, the average value of the current values of the domains 24 extracted at the time of calculation of the depth h of the depressed portions 26 was set as a current value A2 of the domains 24. Meanwhile, a portion other than the domains 24 was deemed to be the matrix 23, and the average value of the current values thereof was taken as a current value A1 of the matrix 23.

In the present embodiment the current value A2 of the domains 24 is larger than the current value A1 of the matrix 23. That is, the electric resistance of the domains 24 is lower than the electric resistance of the matrix 23. The higher the ratio A2/A1 is, the lower is the electric resistance of the domains 24 as compared with that of the matrix 23.

Measurement of Feret Diameter of Depressed Portion

Figure 3:
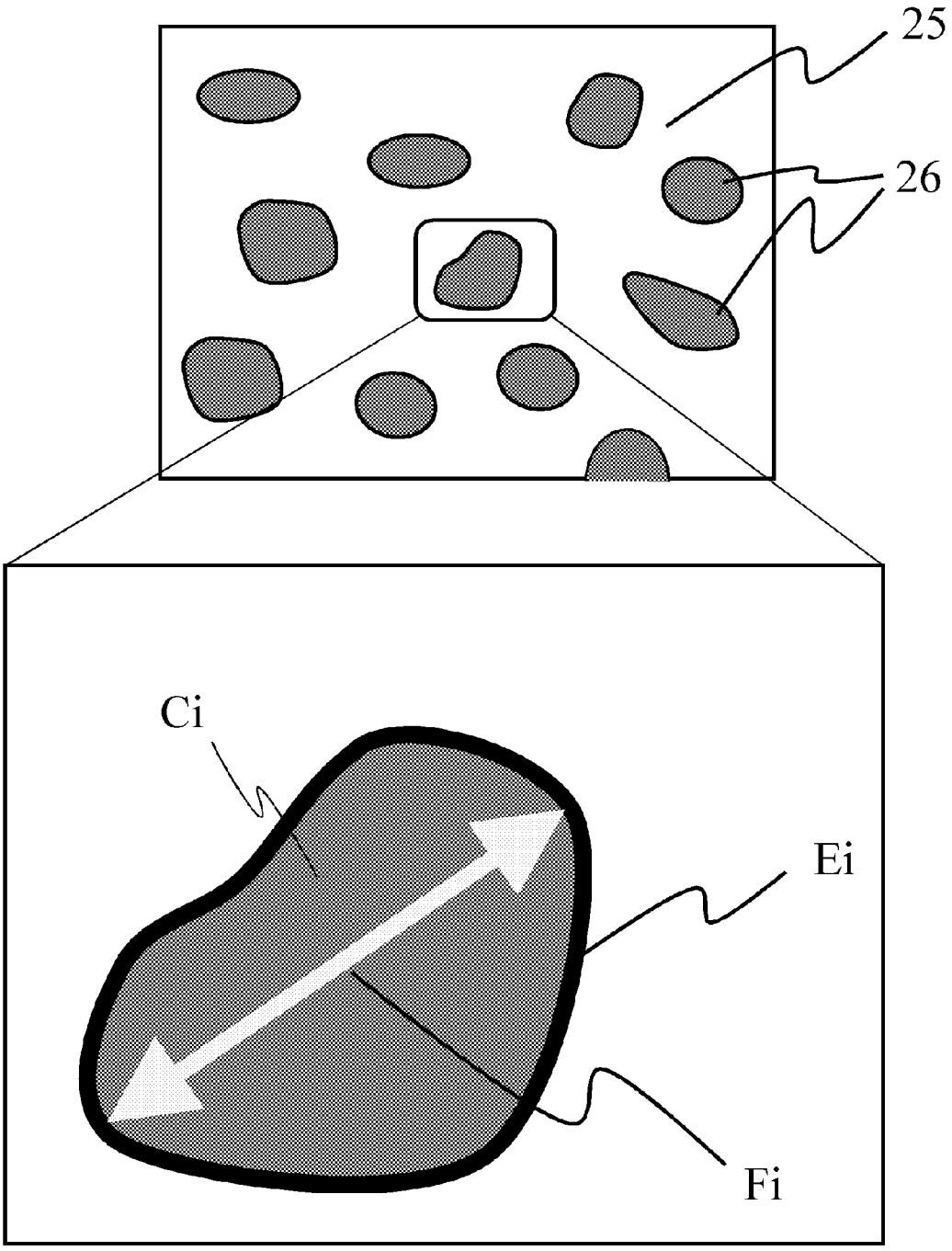
FIG. 3 is a schematic diagram of a charging roller in an embodiment of the present invention, as viewed in a direction perpendicular to the surface of the charging roller.

FIG. 3 is a diagram of the surface 22*a* of the elastic layer 22 of the charging roller 2 as seen from the vertical direction. A method of measuring the Feret diameter Fi of the depressed portions 26 will be explained next with reference to FIG. 3. An atomic force microscope (AFM) can be used to measure the Feret diameter Fi of the depressed portions 26 of the charging roller 2 in the present embodiment, similarly to the measurement of the depth of the depressed portions 26 described above.

Among straight lines joining two arbitrary points on respective contour lines Ei of respective isolated depressed portions Ci, the longest distance (distance Fi) among two such points yields the Feret diameter Fi. Herein, i denotes an individual number from 1 up to the total number of the depressed portions 26 in the depressed portion 26 in the measurement area.

The Feret diameter Fi is measured by identifying, on the basis of the AFM shape image, the region J of the depressed portions 26 in which the domains 24 are present on the bottom face. The height of the portion used for measuring the Feret diameter Fi was a midpoint between the average value of the height direction Z μm of the region J and the average value of a portion other than the region J. The measurement conditions adopted herein were identical to those for the measurement of the depth of the depressed portions 26 described above. Five arbitrary sites of dissimilar position in the longitudinal direction of the charging roller 2 are measured, and the maximum value of the Feret diameter Fi in all the measured isolated depressed portions Ci is taken as a maximum Feret diameter 2Rs.

A depressed portion radius Rs which is the value of half the maximum Feret diameter 2Rs of the depressed portions 26 is then calculated from the measured value of the maximum Feret diameter 2Rs of the depressed portions 26 thus obtained.

Measurement of Toner Particle Diameter

A measured value resulting from a measurement in accordance with the below-described measurement method can be used as a volume-average particle diameter 2Rt of the toner 90. Herein Coulter Multisizer IV (by Beckman Coulter Inc.) is used as a measuring device. As an electrolyte solution there can be used a solution resulting from dispersing special grade sodium chloride in ion-exchanged water to a concentration of about 1 mass %, for instance ISOTON II (by Beckman Coulter Inc.). The measurement method involves adding 0.5 ml of alkylbenzene sulfonate as a dispersing agent to 100 ml of an electrolyte solution, with further addition of 10 mg of a measurement sample. The electrolyte solution having the measurement sample suspended therein is subjected to a dispersion treatment for 1 minute using an ultrasonic disperser, the volume-basis particle size distribution is measured at a 30 μm aperture using a measuring device, and the measured median diameter (D50) is taken as the volume-average particle diameter 2Rt. Toner radius Rt, which is the value of half measured value of the volume-average particle diameter 2Rt of the toner 90, is also calculated.

Measurement of Particle Diameter of Coating Material

A number-average particle diameter p of the coating material 91 is measured using a scanning electron microscope (SEM) (S-4800, by Hitachi High-Technologies Corporation). The toner 90 coated with the coating material 91 is observed, and the major axes of 100 primary particles of the coating material 91 are randomly measured in a field of view magnified up to 200,000×, to work out the number-average particle diameter p. The observation magnification is adjusted as appropriate depending on the size of the coating material 91.

A more specific example of the charging roller 2 of the present embodiment will be explained below along with a comparison versus a Comparative Example.

Example 1-1

Preparation of Carbon Masterbatch (CMB) 1

Herein CMB 1 was prepared by mixing the carbon masterbatch (CMB) starting materials given in Table 1 below in the compounding amounts set out in Table 1. A six-liter pressure kneader (product name: TD6-15MDX, by Toshin Co., Ltd.) was used as the mixer. The mixing conditions were set to filling ratio of 70 vol %, blade rotational speed of 30 rpm, and mixing for 16 minutes.

TABLE 1

| Material (Product name; manufacturer) | Compounding amount (parts by mass) |
|---|---|
| SBR (Tufdene 2003; Asahi Kasei Corporation) | 15 |
| Carbon black (Tokablack #5500; Tokai Carbon Co., Ltd.) | 12 |
| Zinc oxide | 0.75 |
| Zinc stearate | 0.15 |

Calculation of CMB Die Swell

The die swell value (DS(d)) of CMB 1 prepared above was calculated in accordance with the following method.

Specifically, die swell is measured using a capillary rheometer (product name: Capillograph 1D model, by Toyo Seiki Co., Ltd.) in accordance with JIS K 7199:1999.

The measurement was carried out with capillary length: 10 mm; capillary diameter D: 2 mm; furnace body diameter: 9.55 mm; load cell type: 20 kN; and measurement temperature=80° C. To work out the die swell, the diameter R (mm) of a strand extruded at a piston speed of 100 mm/minute (shear rate: $1.52\times10^2$) was measured, and was calculated as die swell DS=R/D.

Calculation of Die Swell Value of Starting Material 1 for Forming Kneaded Rubber Composition A The materials given in Table 2 below were prepared as the starting materials of a kneaded rubber composition A.

These materials were mixed in the compounding amounts given in Table 2. A six-liter pressure kneader (product name: TD6-15MDX, by Toshin Co., Ltd.) was used as the mixer. The mixing conditions were set to filling ratio of 70 vol %, blade rotational speed of 30 rpm, and mixing for 16 minutes. The die swell value (DS(m)) of the obtained mixture was calculated in accordance with the same calculation method as that of the die swell of the CMB.

TABLE 2

| Material (Product name; manufacturer) | Compounding amount (parts by mass) |
|---|---|
| NBR (N230SL; JSR Corporation) | 85 |
| Zinc oxide | 4.25 |
| Zinc stearate | 0.85 |
| Calcium carbonate (Super #1700; Maruo Calcium Co., Ltd.) | 21.25 |

Preparation of Unvulcanized Rubber Composition 1

Starting materials given in Table 2 were added to the above CMB 1, with kneading to yield a kneaded rubber composition A. A six-liter pressure kneader (product name: TD6-15MDX, by Toshin Co., Ltd.) was used as the mixer. The mixing conditions were set to filling ratio of 70 vol %, blade rotational speed of 30 rpm, and mixing for 16 minutes.

The starting materials given in Table 3 were added to the obtained kneaded rubber composition A, with further kneading to thereby obtain unvulcanized rubber composition 1 as a kneaded rubber composition B. An open roll having a roll diameter of 12 inches (0.30 m) was used as the mixer. The mixing conditions were set so that the rotational speed of a front roll was 10 rpm, the rotational speed of a rear roll was 8 rpm, and roll gap was 2 mm, to perform a total of 20 left-right cuts followed by 10 thinning passes with roll clearance set to 0.5 mm.

TABLE 3

| Material (Product name; manufacturer) | Compounding amount (parts by mass) |
|---|---|
| Sulfur | 1 |
| Vulcanization accelerator 1 (NOCCELER TS; Ouchi Shinko Chemical Industrial Co., Ltd.) | 1 |
| Vulcanization accelerator 2 (NOCCELER DM; Ouchi Shinko Chemical industrial Co., Ltd.) | 1 |

Molding of Vulcanized Rubber Layer

Firstly, the following operation was performed in order to obtain a core metal having an adhesive layer for bonding a vulcanized rubber layer. Specifically, a conductive vulcanization adhesive (product name: Metaloc U-20; by Toyokagaku Kenkyusho Co., Ltd.) was applied over 222 mm of a central portion, in the axial direction, of a cylindrical conductive core metal (made of steel and with a nickel-plated surface) having a diameter of 6 mm and a length of 252 mm, with drying for 30 minutes at 80° C.

The core metal having the above adhesive layer was coated with unvulcanized rubber composition 1 prepared above, using a crosshead extrusion molding machine, to obtain a crowned-shaped unvulcanized rubber roller. Molding was performed with the molding temperature set to 100° C. and the screw rotational speed to 10 rpm, while modifying the feed rate of the core metal. Molding was carried out to yield a thick unvulcanized rubber roller, for an inner diameter of the die of the crosshead extrusion molding machine of 8.4 mm, so that the outer diameter of the middle of the unvulcanized rubber roller in the axial direction was 8.6 mm and the outer diameter at the ends was 8.5 mm.

Thereafter the layer of unvulcanized rubber composition 1 was vulcanized through heating in an electric furnace at a temperature of 160° C. for 40 minutes, to yield a vulcanized rubber layer. Both ends of the vulcanized rubber layer were cut to an axial-direction length of 232 mm, to yield a vulcanized rubber roller.

Electron Beam Irradiation of Vulcanized Rubber Layer after Extrusion

The surface of the obtained vulcanized rubber roller was irradiated with electron beams, to obtain Charging roller c1 having a cured region on the surface of the elastic layer (surface layer). An electron beam irradiation device (by Iwasaki Electric Co., Ltd.) having a maximum acceleration voltage of 150 kV and a maximum electron current of 40 mA was used for electron beam irradiation, while under nitrogen purging at the time of irradiation. The electron beam irradiation conditions were acceleration voltage: 150 kV; electron current: 35 mA; dose: 1,323 kGy; processing rate: 1 m/min; and oxygen concentration: 100 ppm.

Examples 1-2 to 1-7

Preparation of CMB 2 to CMB 7

Herein CMB 2 to CMB 7 were prepared in the same way as CMB 1, except that now the materials given in Table 4 were used in the compounding amounts (parts by mass) given in Table 4. Die swell values were calculated in the same way as for CMB 1.

TABLE 4

| Material | CMB | | | | | | |
|---|---|---|---|---|---|---|---|
| (Product name; manufacturer) | 1 | 2 | 3 | 4 | 5 | 6 | 7 |
| SBR (Tufdene 2003; Asahi Kasei Corporation) | 15 | 10.5 | 13.3 | 4 | — | 1 | 16.8 |
| NBR (N230SL; JSR Corporation) | — | — | — | — | 15 | — | — |
| Liquid SBR (L-SBR-820; Kuraray Co., Ltd.) | — | 4.5 | 5.7 | — | — | — | 7.2 |
| Carbon black (Tokablack #5500; Tokai Carbon Co., Ltd.) | 12 | 9 | 15.2 | 3.2 | 13.5 | 0.8 | 9.6 |
| Zinc oxide | 0.75 | 0.75 | 0.95 | 0.2 | 0.75 | 0.05 | 1.2 |
| Zinc stearate | 0.15 | 0.15 | 0.19 | 0.04 | 0.15 | 0.01 | 0.24 |

Calculation of Die Swell Value of Starting Materials 2 to 7 for Forming Kneaded Rubber Composition A The die swell value of the starting materials for forming kneaded rubber composition A was calculated in the same way as in Example 1-1, but herein the materials given in Table 5 were used in the compounding amounts (parts by mass) given in Table 5.

TABLE 5

| Material (Product name: manufacturer) | Starting material for forming kneaded rubber composition A 1 | 2 | 3 | 4 | 5 | 6 | 7 |
|---|---|---|---|---|---|---|---|
| NBR (N230SL; JSR Corporation) | 85 | 85 | 81 | 67.2 | — | 99 | 85 |
| GECO (EPICHLOMER CG105; Osaka Soda Co., Ltd.) | — | — | — | — | 85 | — | — |
| Liquid SBR (N280; JSR Corporation) | — | — | — | 28.8 | — | — | — |
| Zinc oxide | 4.25 | 4.25 | 4.05 | 4.8 | 4.25 | 4.95 | 3.8 |
| Zinc stearate | 0.85 | 0.85 | 0.81 | 0.96 | 0.85 | 0.99 | 0.76 |
| Calcium carbonate (Super #1700, Maruo Calcium Co., Ltd.) | 21.25 | 21.25 | 20.25 | 16.8 | 21.25 | 24.75 | 19 |
| Silica (Nipsil VN3, Tosoh Silica Corporation) | — | 21.25 | — | — | — | — | 19 |
| Ion-conductive agent (LV70, ADEKA Corporation) | — | — | — | 1 | — | 1.5 | — |

Production of Unvulcanized Rubber Compositions 2 to 7 and of Charging Rollers 2 to 7

Unvulcanized rubber compositions 2 to 7 were prepared in the same way as unvulcanized rubber composition 1 according to Example 1-1, but using herein CMB 2 to CMB 7, and Starting materials 2 to 7 for forming kneaded rubber composition A.

Charging rollers c2 to c7 were then produced and evaluated in the same way as in Example 1-1, but using herein unvulcanized rubber compositions 2 to 7.

Examples 1-8 to 1-21

Examples 1-8 to 1-21 differ from Examples 1-1 to 1-7 as regards the combination of the charging roller 2 that is used, the toner particle of the toner 90, and the coating material 91. In Examples 1-8 to 1-21, the charging roller 2 that was used was one of Charging rollers c1 to c7 of Examples 1-1 to 1-7 given in the tables of FIGS. 9 and 10, respectively. As the tables of FIGS. 9 and 10 reveal, the toner 90 and the size of the coating material 91 (toner radius Rt or number-average particle diameter p of the coating material 91) were different from those of Examples 1-1 to 1-7.

Example 1-22

In the section (Preparation of unvulcanized rubber composition 1) of Example 1-1, spherical acrylic resin particles (product name: Techpolymer MBX-20, particle diameter 20 μm, by Sekisui Kasei Co., Ltd.) were added in a compounding amount of 10 parts by mass, besides CMB 1 and the starting materials given in Table 2. Charging roller c8 was otherwise produced and evaluated in the same way as in Example 1-1.

The spherical acrylic resin particles are crosslinked, and hence are incompatible with the NBR that makes up the matrix.

Further, the spherical acrylic resin particles are electrically insulating, and hence are treated as a part of the matrix 23 containing rubber and having higher electric resistance than that of the domains 24; the volume fraction of the domains 24 was calculated and also and DS(m)/DS(d), the domain count and A2/A1 were measured herein.

Example 1-23

In (Preparation of unvulcanized rubber composition 1) of Example 1-1, spherical urethane resin particles (trade name: Art Pearl C-400 transparent, particle diameter 20 μm, by Negami Kagaku KK) were added in a compounding amount of 10 parts by mass, besides CMB 1 and the starting materials given in Table 2. Charging roller c9 was otherwise produced and evaluated in the same way as in Example 1-1.

The spherical urethane resin particles are crosslinked, and hence are incompatible with the NBR that makes up the matrix.

Further, the spherical urethane resin particles are electrically insulating, and hence are treated as a part of the matrix 23 containing rubber and having higher electric resistance than that of the domains 24; the volume fraction of the domains 24 was calculated and also and DS(m)/DS(d), the domain count and A2/A1 were measured herein.

Example 1-24

Spherical polyethylene resin particle masterbatch PE-MB1 was prepared as follows.

The materials given in Table 6 were prepared as starting materials. These materials were mixed in the compounding amount given in Table 6, to yield Spherical polyethylene resin particle masterbatch PE-MB1.

A six-liter pressure kneader (product name: TD6-15MDX, by Toshin Co., Ltd.) was used as the mixer. The mixing conditions were set to filling ratio of 50 vol %, blade rotational speed of 10 rpm, and mixing for 5 minutes. The highest saturated temperature at the time of mixing was 80° C., which was a temperature value sufficiently lower than 120° C., as the melting point of polyethylene.

TABLE 6

| Material (Product name; manufacturer) | Compounding amount (parts by mass) |
|---|---|
| Spherical polyethylene resin particles (MIPELON XM-220; Mitsui Chemicals Inc.) | 70 |
| NBR (Nipol DN401LL; Japan Zeon Corporation) | 20 |
| Liquid NBR (Nipol1312; Japan Zeon Corporation) | 10 |

Herein Spherical polyethylene resin particle masterbatch PE-MB1 prepared above was added, in a compounding amount of 14.3 parts by mass, to unvulcanized rubber composition 1 prepared in Example 1-1, with kneading using an open roll, to yield unvulcanized rubber composition 16.

The maximum saturated temperature of the unvulcanized rubber composition 8 at the time of open roll kneading was 92° C.

The spherical polyethylene resin particles are kneaded at or below the melting temperature, and hence are incompatible with the NBR of the matrix 23.

Further, the spherical polyethylene resin particles are electrically insulating, and hence are treated as a part of the matrix 23 containing rubber and having higher electric resistance than that of the domains 24; the volume fraction of the domains 24 was calculated and also and DS(m)/DS (d), the domain count and A2/A1 were measured herein.

Otherwise, Charging roller c10 was produced and evaluated in the same way as in Example 1-1, but using herein unvulcanized rubber composition 8 instead of unvulcanized rubber composition 1.

Comparative Example 1

The elastic layer 22 of the charging roller 2 in Comparative Example 1 (1-1 and 1-2) will be explained next. The configuration of the charging roller 2 other than for the elastic layer 22 exhibits substantially no changes with respect to that in Example 1, and hence an explanation thereof will be omitted herein. The elastic layer 22 of Comparative Example 1 has, similarly to Example 1, a matrix-domain structure (sea-island structure) made up of a matrix 23 (sea phase) containing a rubber A, and domains 24 (island phase) of lower electric resistance than that of the matrix 23, and containing a rubber B and an electron-conductive material. The matrix 23 and the domains 24 are exposed on the surface 22*a* of the elastic layer 22. Unlike in Example 1, however, the surface 22*a* of the elastic layer 22 of the charging roller 2 does not have a plurality of depressed portions 26.

Comparative Example 1-1

In the process of Example 1-1, the surface of the vulcanized rubber layer of the vulcanized rubber roller after (Molding of the vulcanized rubber layer) and prior to (Electron beam irradiation of the vulcanized rubber layer after extrusion) is polished using a polishing machine according to a plunge-cut polishing scheme, to yield a crowned shape having an end diameter of 8.3 mm and a central portion diameter of 8.5 mm. Charging roller c11 was produced and evaluated in the same way as in Example 1-1, but herein the (Electron beam irradiation of the vulcanized rubber layer after extrusion) of Example 1-1 was carried out after the polishing step.

Comparative Example 1-2

Charging roller c12 was produced and evaluated in the same way as in Example 1-1 but herein (Molding of a vulcanized rubber layer) in the process of Example 1-1 was carried out by molding using a mold, instead of by extrusion, to yield a crowned shape having an end diameter of 8.5 mm and a central portion diameter of 8.6 mm.

The mold molding conditions involved using a split mold and a press, at pressure: 10 MPa, temperature: 160° C. and molding time: 40 minutes.

Method for Evaluating Image Density Non-Uniformity

Image evaluation was performed as follows. Using the image forming apparatus 100 there were formed over 8,000 images, at a print percentage of 1%, in an environment at room temperature of 15° C. and relative humidity of 10% Rh. An intermittent lapse of 3 seconds was provided for every 2 images that were formed. Image density non-uniformity of a halftone image after formation of the 8,000 images was visually evaluated on the basis of the following criteria.

A: absence of image density non-uniformity

B: slight image density non-uniformity, but not problematic in actual use

C: noticeable image density non-uniformity, problematic in actual use

Comparison Between Example 1 and Comparative Example 1

FIGS. 9 and 10 illustrate the measurement results of the charging roller 2, the toner 90, and the coating material 91, as well as image evaluation results, of Example 1 (1-1 to 1-24) and Comparative Example 1 (1-1 and 1-2).

As the tables in FIGS. 9 and 10 reveal, image density non-uniformity occurred noticeably in Comparative Example 1 (1-1 and 1-2) in which a bottom section did not have a plurality of depressed portion being the domains 24. By contrast in Example 1 (1-1 to 1-24) in which the bottom section has the plurality of depressed portions being the domains 24, image density non-uniformity does not occur, or if so, can be kept low at a slight level that is not problematic in actual use.

Figure 6A:
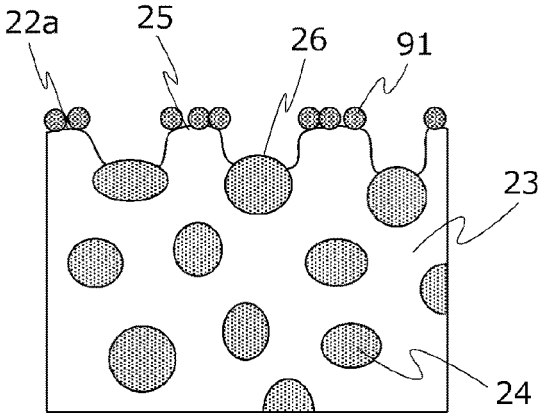
FIGS. 6A and 6B are diagrams illustrating a contaminated state of a charging roller in Example 1 and Comparative Example 1.
Figure 6B:
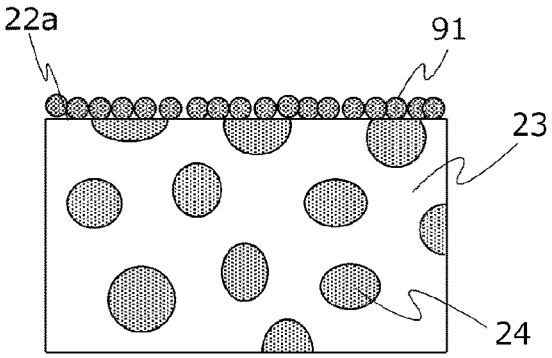

FIGS. 6A and 6B depict the state of fouling on the surface 22*a* of the charging roller 2 in the case of repeated image forming operations and in the case of various instances of repeated image stabilization control using the toner 90 in Example 1 (1-1 to 1-24) and Comparative Example 1 (1-1 and 1-2). An image bearing member cleanerless system is resorted to herein, and hence the toner 90 remaining on the photosensitive drum 1 without being transferred is recovered by the developing apparatus 4 after the toner has passed through the charged section. At that time, the coating material 91 that coats the toner 90 comes into contact with the surface 22*a* of the charging roller 2.

In Comparative Example 1, as illustrated in FIG. 6B, depressed portions 26 such as those of Example 1 are not provided, and hence the coating material 91 of the toner 90 is in contact with the entire surface 22*a* including the exposed domains 24. In consequence, the coating material 91 detaches from the toner 90 and adheres also to the domains 24 constituting discharge points, on account of the low electric resistance of the domains 24. As a result the charging performance of the charging roller 2 becomes unstable, and accordingly the charging potential of the surface of the photosensitive drum 1 varies, image density and/or line width deviate from desired values, charging cannot be carried out uniformly, and image defects occur such as image density non-uniformity.

As illustrated in FIG. 6A, Example 1 exhibits by contrast a surface profile having domains 24 on the bottom face of a plurality of depressed portions 26, i.e. a surface profile in which the coating material 91 does not come readily in contact with the exposed domains 24. Therefore, the coating material 91 does not readily adhere to the domains 24 on the bottom face of the depressed portions 26; instead, the coating material 91 adheres only to the protruded portions 25. Even if grime derived from the coating material 91 adheres on the matrix 23, which is less prone to undergo discharge readily by virtue of the high electric resistance thereof, charging performance is however little affected since the discharge amount is inherently small. In addition, no grime derived from the coating material 91 adheres to the domains 24 constituting discharge points by virtue of the low electric resistance of the domains 24, and hence charging performance can be maintained. Therefore, the electric properties being the characterizing feature of the charging roller 2 having a sea-island structure are uniform, and thus stable charging performance, derived from a small voltage dependence and small environmental fluctuations, can be maintained, and uniform images can be obtained stably.

Details about Surface Profile of Charging Roller

A detailed explanation follows next, with reference to FIG. 5, on the shape of the surface 22*a* of the charging roller 2 in the present embodiment, and in particular on the relationship between the sizes of the depressed portions 26, the toner 90 and the coating material 91. FIG. 5 is a schematic diagram illustrating the positional relationship between the coating material 91, the protruded portions 25 and the depressed portions 26, at a time where the toner 90 and the coating material 91 on the surface of the toner 90 are at the closest position to the bottom face of the depressed portions 26, upon contact of the toner 90 with the surface 22*a* of the charging roller 2.

Although only one coating material 91 particle and one depressed portion 26 are illustrated in FIG. 5, in actuality multiple particles of coating material 91 are scattered over the entire surface of the toner 90, and likewise multiple depressed portions 26 are interspersed over the entire surface 22*a* of the charging roller 2.

In Example 1-1, for instance, the volume-average particle diameter 2Rt of the toner 90 is 7.00 μm, whereas the Feret diameters Fi of respective isolated depressed portions 26 are small, namely no greater than 1.76 μm which is the maximum Feret diameter 2Rs. That is, Expression 1 below is satisfied as a relational expression between the maximum Feret diameter 2Rs which is the maximum value of the Feret diameter Fi of the depressed portions 26 and the volume-average particle diameter 2Rt of the toner 90.

$$2Rs<2Rt \qquad \text{Expression 1}$$

In the tables of FIGS. 9 and 10, YES denotes that Expression 1 is satisfied by the respective example, while NO denotes that Expression 1 is not satisfied by the respective example. By virtue of such a relationship the toner 90 can be prevented from intruding into the depressed portions 26 upon contact between the surface 22*a* of the charging roller 2 and the toner 90. Therefore it is possible to further prevent the domains 24 on the bottom surface of the depressed portions 26 from being contaminated by the coating material 91 that coats the toner particle of the toner 90. As a result, image density non-uniformity derived from defective charging could be further suppressed in Examples 1-13 and 1-16, which satisfy Expression 1, than in the case of Example 1-14, which does not satisfy Expression 1.

For instance in Example 1-1, moreover, the depth h (average depth) of the depressed portions 26 is larger than the number-average particle diameter p of the coating material 91. Further, the depth h of the depressed portion 26 satisfies Expression 2 below as a relational expression of the depressed portion radius Rs, the toner radius Rt, and the number-average particle diameter p of the coating material 91.

$$h>Rt-(Rt^2-Rs^2)^{1/2}+p \qquad \text{Expression 2}$$

In the tables of FIGS. 9 and 10, YES denotes that Expression 2 is satisfied by the respective example, while NO denotes that Expression 2 is not satisfied by the respective example. Instances where calculation is not possible due to Expression 1 not being satisfied are denoted as - (hyphen).

By virtue of such a relationship, even if part of the toner particle intrudes into the depressed portions 26, as illustrated in FIG. 5, the coating material 91 on the surface of the toner 90 at the depressed portions 26 can however be prevented from coming into contact with the domains 24 on the bottom face of the depressed portions 26. As a result, it is possible to yet further prevent the domains 24 from being contaminated with the coating material 91. In consequence, the image density non-uniformity derived from defective charging could be further suppressed in Example 1-9 and 1-18, which satisfy Expression 2, than in the case of Example 1-19, which does not satisfy Expression 2. Also, the image density non-uniformity derived from defective charging could be further suppressed in Examples 1-10, 1-12 and 1-20, which satisfy Expression 2, than in the case of Example 1-21, which does not satisfy Expression 2. Further, by satisfying both Expression 1 and Expression 2, image density non-uniformity derived from defective charging could be further suppressed in Examples 1-1 to 1-10, 1-12 to 1-18, 1-20 and 1-22 to 1-24, and accordingly it was possible to achieve good image quality more stably in a durability test.

As explained above, the configuration of the present embodiment allows suppressing defective charging derived from fouling on a charging member, and allows achieving good image quality stably, while relying on a simple configuration.

In the present embodiment an apparatus configuration has been illustrated in which a toner image is transferred from the photosensitive drum 1 to the intermediate transfer belt 53 which is an intermediate transfer member, as a transfer receiving body, but an apparatus configuration may be adopted in which the toner image is transferred directly from the photosensitive drum 1 to a recording material as a transfer receiving body.

Embodiment 2

In Embodiment 2 of the present invention features other than those concerning the toner 90 as a developer exhibit no changes with respect to those of Embodiment 1, and a recurrent explanation thereof will be omitted.

In the toner 90 used in Embodiment 2 the surface of a toner particle containing an organic compound, which is the body of the particle, is coated with a coating material 91 containing an organosilicon polymer as an inorganic compound, as a result of which multiple semi-spherical protruded portions become formed on the surface of the toner.

The toner 90 in Embodiment 2 contains a toner particle containing an organic compound, and has a coating material 91 containing an organosilicon polymer, which is an inorganic compound, on the surface of the toner particle, such that the organosilicon polymer has the structure given by Formula (3).

$$R—SiO_{3/2} \qquad \text{Formula (3)}$$

(where R represents a hydrocarbon group having at least 1 and not more than 6 carbon atoms).

In the organosilicon polymer having the structure of Formula (3) one of the four valences of the Si atom is bonded to R and the remaining three are bonded to the O atom. The two valences of the O atom are bonded to Si, i.e. make up a siloxane bond (Si—O—Si). In terms of the Si atoms and O atoms, the organosilicon polymer can be expressed as $—SiO_{3/2}$, since the polymer has three O atoms for every two Si atoms. The $—SiO_{3/2}$ structure of this organosilicon polymer has properties similar to those of silica ($SiO_2$) made up of multiple siloxane bonds.

In the structure represented by Formula (3), R is preferably a hydrocarbon group having at least 1 and not more than 6 carbon atoms. The charge amount is readily stabilized as a result. An aliphatic hydrocarbon group having at least 1 and not more than 5 carbon atoms or a phenyl group, exhibiting excellent environment stability, is preferred herein.

More preferably, R is a hydrocarbon group having at least 1 and not more than 3 carbon atoms, since charging performance is further enhanced in that case. When charging performance is good, transferability is good and the amount of untransferred toner is small; as a result, contamination of the charging member and of the transfer member improves.

Preferred examples of the hydrocarbon group having at least 1 and not more than 3 carbon atoms include a methyl group, an ethyl group, a propyl group and a vinyl group. From the viewpoint of environment stability and storage stability, R is more preferably a methyl group.

A sol-gel method is preferred as a production example of the organosilicon polymer. The sol-gel method involves forming a gel by way of a sol state, through hydrolysis and condensation polymerization of a starting material in the form of a liquid starting material; the sol-gel method is used for synthesizing glass, ceramics, organic-inorganic hybrids and nanocomposites. By resorting to this production method it becomes possible to produce functional materials of various shapes, such as a surface layer, fibers, bulk bodies, fine particles and the like, at low temperature and out of a liquid phase.

Specifically, the organosilicon polymer that forms the coating material 91 present on the surface layer of the toner particle is preferably generated, specifically, through hydrolysis and condensation polymerization of a silicon compound typified by an alkoxysilane.

By providing the surface layer containing such an organosilicon polymer on one toner particle, a toner 90 can be obtained that boasts superior storage stability, and has improved environment stability, such that the performance of the toner 90 with prolonged use is not prone to drop.

The sol-gel method starts from a liquid and materials are formed through gelling of that liquid, so that various fine structures and shapes can be formed as a result. In a case in particular where the toner particle is produced in an aqueous medium, precipitation on the surface of the toner particle is facilitated by the hydrophilicity derived from a hydrophilic group such as a silanol group of an organosilicon compound. The above fine structure and shape can be adjusted for instance on the basis of the reaction temperature, reaction time, reaction solvent, pH, as well as the type and amount of the organosilicon compound.

The organosilicon polymer that forms the coating material 91 is preferably a polycondensation product of an organosilicon compound having a structure represented by Formula (Z) below.

[C1]

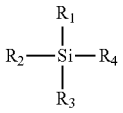

(Z)

(In formula (Z), $R_1$ represents a hydrocarbon group having at least 1 and not more than 6 carbon atoms, and $R_2$, $R_3$ and $R_4$ represent each independently a halogen atom, a hydroxy group, an acetoxy group or an alkoxy group.)

The hydrocarbon group in $R_1$ (preferably an alkyl group) allows improving hydrophobicity, and allows obtaining a toner particle having superior environment stability. An aryl group which is an aromatic hydrocarbon group, for instance a phenyl group, can also be used herein as the hydrocarbon group. In a case where $R_1$ is highly hydrophobic, charge amount fluctuations tend to increase in various environments; in terms of environment stability, therefore, $R_1$ is preferably a hydrocarbon group having at least 1 and not more than 3 carbon atoms, and is more preferably a methyl group.

Further, $R_2$, $R_3$ and $R_4$ are each independently a halogen atom, a hydroxy group, an acetoxy group or an alkoxy group (hereafter also referred to as reactive group). These reactive groups form a crosslinked structure through hydrolysis, addition polymerization and condensation polymerization, and allow obtaining a toner excellent in member contamination resistance and development durability. Preferably the reactive group is an alkoxy group having at least 1 and not more than 3 carbon atoms, and more preferably a methoxy group or an ethoxy group, in terms of exhibiting gentle hydrolyzability at room temperature, and in terms of deposition and coating properties on the surface of the toner particle. Hydrolysis, addition polymerization and condensation polymerization of $R_2$, $R_3$ and $R_4$ can be controlled on the basis of the reaction temperature, reaction time, reaction solvent and pH.

To obtain the organosilicon polymer used in the present embodiment, an organosilicon compound (hereafter also referred to as trifunctional silane) having three reactive groups ($R_2$, $R_3$ and $R_4$) in the molecule, excluding $R_1$ in the formula (Z) above, may be used as a single type or as a combination of a plurality of types.

The content of the organosilicon polymer that forms the coating material 91 in the toner 90 is preferably at least 0.5 mass % and not more than 10.5 mass %.

By virtue of the fact that the content of the organosilicon polymer is 0.5% by mass or higher, the surface free energy of the surface layer can be further reduced, flowability can be improved, and fouling of the member and fogging can be suppressed. The occurrence of charge-up can be made unlikelier by virtue of the fact that the content of the organosilicon polymer is 10.5 mass % or less. The content of the organosilicon polymer can be controlled on the basis of the type and amount of the organosilicon compound used for forming the organosilicon polymer, the method for producing the toner particle and the reaction temperature, the reaction time, the reaction solvent and the pH involved at the time of formation of the organosilicon polymer.

Preferably the toner particle and the coating material 91 that contains the organosilicon polymer are in contact with each other without gaps in between. As a result, bleeding derived for instance from the resin component and the release agent inward of the surface layer of the toner particle is suppressed, and a toner 90 boasting superior storage stability, environment stability and development durability can thus be obtained. Besides the above organosilicon polymer, the surface layer may contain a resin such as a styrene-acrylic copolymer resin, a polyester resin or a urethane resin, and also various additives.

After coating of the toner particle with the organic silicon polymer, the toner 90 can then be achieved through external addition of an external additive as in Embodiment 1, for the purpose of further improving flowability, charging performance and so forth; in Embodiment 2, however, the toner 90 is obtained such without external addition.

In Embodiment 2 the toner radius Rt was 3.50 μm, and the number-average particle diameter p of the coating material 91 was 0.10 μm. The number-average particle diameter p of the coating material 91 was measured in accordance with the method described above, for a plurality of semi-spherical protruded portions formed out of an organosilicon polymer on the surface of the toner particle.

As in the case of Embodiment 1, also when using a toner 90 such as that of Embodiment 2 the charging roller 2 of the present invention allows suppressing defective charging derived from fouling on a charging member, and allows achieving good image quality stably, while relying on a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191539, filed on Oct. 18, 2019, which is hereby incorporated by reference herein in its entirety.

What is claimed is:

1. A process cartridge attachable/detachable to/from an image forming apparatus forming an image on a recording material, the process cartridge comprising:

an image bearing member;

a charging member that is in contact with the image bearing member and charges a surface of the image bearing member; and a developing member that forms a developer image by supplying the developer to the surface of the image bearing member, which is charged by the charging member, wherein the process cartridge is configured to recover, with the developing member, the developer remaining on the image bearing member after transfer of the developer image to a transfer receiving member, wherein the charging member has a shaft that is conductive and an elastic layer supported by the shaft and being in contact with the image bearing member, wherein the elastic layer has a matrix containing a first rubber, and a plurality of domains containing a second rubber and an electron-conductive agent and being interspersed in the matrix, wherein an electric resistance of the domains is lower than an electric resistance of the matrix, wherein the matrix is exposed on an outer surface of the elastic layer and forms a plurality of depressed portions, and wherein the plurality of domains include a domain exposed at a bottom section of the depressed portion.

2. The process cartridge according to claim 1, wherein in the elastic layer, when the surface of the elastic layer viewed in a direction perpendicular to the surface, among straight lines each joining two arbitrary points on a contour line of an isolated depressed portion of the depressed portions, a maximum value of distance Fi longest between the two points is smaller than a volume-average particle diameter of the developer.

3. The process cartridge according to claim 2, wherein the developer contains a toner particle containing an organic compound, and a coating material that contains an inorganic compound and coats the toner particle, and wherein an average depth of the depressed portions is larger than $Rt-(Rt^2-Rs^2)^{1/2}+p$, where Rs is half the maximum value of the distance Fi of the depressed portion, Rt is half the volume-average particle diameter of the toner particle, and p is a number-average particle diameter of the coating material.

4. The process cartridge according to claim 3, wherein the coating material contains an organosilicon polymer as the inorganic compound.

5. The process cartridge according to claim 1, wherein the shaft of the charging member is a cylindrical shaft, and the charging member has the elastic layer on an outer peripheral surface of the cylindrical shaft.

6. The process cartridge according to claim 1, wherein the charging member is configured to rotate following rotation of the image bearing member.

7. The process cartridge according to claim 1, wherein in the rotational direction of the image bearing member, a charged section, at which the charging member charges the image bearing member, is positioned downstream of a transfer portion, at which the developer image is transferred from the image bearing member to the transfer receiving member, and upstream of a developing portion, at which the electrostatic image is developed into the developer image.

8. The process cartridge according to claim 1, wherein the transfer receiving member is a recording material.

9. The process cartridge according to claim 1, wherein the transfer receiving member is an intermediate transfer member onto which the developer image is transferred from the image bearing member.

10. The process cartridge according to claim 1, wherein the matrix has spherical particles added to the first rubber.

11. An image forming apparatus forming an image on a recording material, the image forming apparatus comprising:

an image bearing member;

a charging member that is in contact with the image bearing member and charges a surface of the image bearing member;

exposure unit for exposing the image bearing member, which is charged by the charging member, so as to form an electrostatic image on the surface of the image bearing member;

developing unit for developing the electrostatic image into a developer image; and transfer member for transferring the developer image from the image bearing member to a transfer receiving member, wherein the image forming apparatus is configured to recover, by the developing unit, developer remaining on the image bearing member after transfer of the developer image to the transfer receiving member, wherein the charging member has a shaft that is conductive, and an elastic layer supported by the shaft and being in contact with the image bearing member, wherein the elastic layer has a matrix containing a first rubber, and a plurality of domains containing a second rubber and an electron-conductive agent and being interspersed in the matrix, wherein an electric resistance of the domains is lower than an electric resistance of the matrix, wherein the matrix is exposed on an outer surface of the elastic layer and forms a plurality of depressed portions, and wherein the plurality of domains include a domain exposed at a bottom section of the depressed portion.

12. The image forming apparatus according to claim 11, wherein the transfer receiving member is a recording material.

13. The image forming apparatus according to claim 11, further comprising:

an intermediate transfer member that serves as the transfer receiving member and onto which the developer image is transferred from the image bearing member by the transfer member serving as first transfer member; and second transfer member for transferring the image bearing member from the intermediate transfer member to a recording material.

* * * * *